US011404197B2

(12) United States Patent
Kubik et al.

(10) Patent No.: US 11,404,197 B2
(45) Date of Patent: Aug. 2, 2022

(54) VIA FOR MAGNETIC CORE OF INDUCTIVE COMPONENT

(71) Applicant: Analog Devices Global Unlimited Company, Hamilton (BM)

(72) Inventors: Jan Kubik, Raheen (IE); Bernard Patrick Stenson, Limerick (IE); Michael Morrissey, Limerick (IE)

(73) Assignee: Analog Devices Global Unlimited Company, Hamilton (BM)

( * ) Notice: Subject to any disclaimer, the term of this patent is extended or adjusted under 35 U.S.C. 154(b) by 721 days.

(21) Appl. No.: 16/003,621

(22) Filed: Jun. 8, 2018

(65) Prior Publication Data

US 2018/0358166 A1 Dec. 13, 2018

Related U.S. Application Data

(60) Provisional application No. 62/517,777, filed on Jun. 9, 2017.

(51) Int. Cl.
*H01F 27/28* (2006.01)
*H01F 5/00* (2006.01)
(Continued)

(52) U.S. Cl.
CPC ..... *H01F 27/263* (2013.01); *H01F 27/255* (2013.01); *H01F 27/2804* (2013.01);
(Continued)

(58) Field of Classification Search
CPC ..... H01F 27/263; H01F 27/2804; H01F 2027/2809; H01F 2017/0053; H01F 2017/0066; H01F 2017/2819
(Continued)

(56) References Cited

U.S. PATENT DOCUMENTS 2,477,749 A 8/1949 Jacob
2,691,767 A 10/1954 De Tar
(Continued)

FOREIGN PATENT DOCUMENTS

CN 1309399 A 8/2001
CN 17480006 A 3/2006
(Continued)

OTHER PUBLICATIONS

International Search Report and Written Opinion dated Dec. 20, 2017 in connection with International Application No. PCT/IB2017/001177.
(Continued)

*Primary Examiner* — Elvin G Enad
*Assistant Examiner* — Joselito S. Baisa
(74) *Attorney, Agent, or Firm* — Wolf, Greenfield & Sacks, P.C.

(57) ABSTRACT

Techniques for fabricating low-loss magnetic vias within a magnetic core are provided. According to some embodiments, vias with small, well-defined sizes may be fabricated without reliance on precise alignment of layers. According to some embodiments, a magnetic core including a low-loss magnetic via can be wrapped around conductive coils of an inductor. The low-loss magnetic vias can improve performance of an inductive component by improving the quality factor relative to higher loss magnetic vias.

20 Claims, 22 Drawing Sheets

(51) Int. Cl.
*H01F 27/26* (2006.01)
*H01F 27/255* (2006.01)
*H01F 27/34* (2006.01)

(52) U.S. Cl.
CPC ..... *H01F 2027/2809* (2013.01); *H01F 2027/2819* (2013.01); *H01F 2027/348* (2013.01)

(58) Field of Classification Search
USPC ..... 336/182, 200
See application file for complete search history.

(56) References Cited

U.S. PATENT DOCUMENTS 2,697,165 A 12/1954 Blossey
2,882,507 A 4/1959 Holz
3,080,641 A 3/1963 Marley
3,262,075 A 7/1966 Podell
3,750,180 A 7/1973 Fujimoto et al.
4,025,379 A 5/1977 Whetstone
4,176,335 A 11/1979 Charpentier
4,617,516 A 10/1986 Schenck
4,656,447 A 4/1987 Keim et al.
4,697,144 A 9/1987 Howbrook
4,873,757 A 10/1989 Williams
4,878,290 A * 11/1989 Masud ..... G11B 5/3116 29/603.14
5,097,243 A * 3/1992 Zieren ..... H01F 36/00 336/200
5,291,782 A 3/1994 Taylor
5,379,172 A * 1/1995 Liao ..... G11B 5/3113 360/125.5
5,465,475 A * 11/1995 Kinoshita ..... G11B 5/313 29/603.16
5,470,491 A * 11/1995 Kodama ..... G11B 5/3106 216/22
5,529,703 A 6/1996 Sprenger et al.
5,548,265 A 8/1996 Saito
5,583,474 A 12/1996 Mizoguchi et al.
5,606,478 A * 2/1997 Chen ..... G11B 5/127 360/119.07
5,640,753 A * 6/1997 Schultz ..... G11B 5/3967 29/603.08
5,808,843 A * 9/1998 Kobayashi ..... G11B 5/398 360/327.31
5,852,866 A 12/1998 Kuettner et al.
5,884,990 A 5/1999 Burghartz et al.
5,966,063 A 10/1999 Sato et al.
5,978,319 A 11/1999 Wang et al.
6,094,123 A 7/2000 Roy
6,121,852 A 9/2000 Mizoguchi et al.
6,160,721 A 12/2000 Kossives et al.
6,209,192 B1 * 4/2001 Urai ..... G11B 5/3116 29/603.13
6,614,093 B2 9/2003 Ott et al.
6,778,358 B1 * 8/2004 Jiang ..... B82Y 10/00 360/125.5
6,803,848 B2 10/2004 Yeo et al.
7,042,319 B2 5/2006 Ishiwata et al.
7,145,427 B2 12/2006 Yoshida et al.
7,209,090 B2 4/2007 Hall et al.
7,229,908 B1 6/2007 Drizlikh et al.
7,425,884 B2 9/2008 Suzui
7,538,653 B2 * 5/2009 Schrom ..... H01F 17/0006 336/200
7,843,304 B2 * 11/2010 Schrom ..... H01F 27/34 336/200
8,050,045 B2 11/2011 Okuzawa et al.
8,089,155 B2 * 1/2012 Lin ..... H01L 24/05 257/E23.145
8,102,236 B1 * 1/2012 Fontana, Jr. ..... H01F 17/0006 336/200
8,233,237 B2 * 7/2012 Anagawa ..... G11B 5/315 360/125.3
8,471,668 B2 6/2013 Hsieh et al.
8,601,673 B2 12/2013 Tseng
9,047,890 B1 * 6/2015 Herget ..... H01F 41/046
9,064,628 B2 * 6/2015 Fontana, Jr. ..... H01F 17/0013
9,324,489 B2 * 4/2016 Fontana, Jr. ..... H01F 27/2804
9,484,136 B2 11/2016 Morrissey et al.
9,865,392 B2 * 1/2018 Groves ..... H01F 17/0033
10,364,143 B2 * 7/2019 Pagani ..... B81C 1/00158
2001/0030591 A1 10/2001 Gardner
2002/0033534 A1 3/2002 Cohen et al.
2002/0037434 A1 3/2002 Feygenson et al.
2002/0125549 A1 9/2002 Cohen et al.
2002/0132136 A1 9/2002 Roshen
2003/0043010 A1 3/2003 Yeo et al.
2003/0048167 A1 3/2003 Inoue et al.
2003/0109118 A1 6/2003 Ott et al.
2004/0166308 A1 8/2004 Raksha et al.
2004/0195647 A1 10/2004 Crawford et al.
2004/0252068 A1 12/2004 Hall et al.
2005/0105225 A1 5/2005 Ahn et al.
2005/0156704 A1 7/2005 Gardner et al.
2005/0195062 A1 9/2005 Yoshida et al.
2006/0261921 A1 11/2006 Welzel et al.
2008/0003699 A1 1/2008 Gardner et al.
2008/0043365 A1 2/2008 Choi et al.
2008/0151615 A1 6/2008 Rodmacq et al.
2008/0238602 A1 * 10/2008 Schrom ..... H01F 17/0006 336/84 M
2008/0253032 A1 * 10/2008 Narushima ..... G11B 5/3133 360/313
2009/0066300 A1 3/2009 Lotfi et al.
2010/0149689 A1 * 6/2010 Tsuchiya ..... G01R 33/093 360/234.3
2010/0195857 A1 8/2010 Gebhardt et al.
2010/0302662 A1 * 12/2010 Toba ..... G11B 5/3173
2012/0131792 A1 5/2012 Tseng
2012/0197366 A1 8/2012 Zeijlemaker et al.
2013/0106552 A1 5/2013 Fontana, Jr. et al.
2013/0234820 A1 9/2013 Yoo et al.
2013/0328165 A1 12/2013 Harburg et al.
2014/0062646 A1 3/2014 Morrissey et al.
2014/0132366 A1 5/2014 Kim et al.
2014/0218153 A1 8/2014 Chen
2014/0362551 A1 12/2014 Moon et al.
2015/0130291 A1 5/2015 Lim et al.
2015/0137931 A1 5/2015 Mano et al.
2015/0145634 A1 5/2015 Kurz et al.
2016/0005530 A1 1/2016 Kubik
2016/0035480 A1 2/2016 Hachiya et al.
2016/0163446 A1 6/2016 Park et al.
2016/0379750 A1 12/2016 Hamada et al.
2017/0169929 A1 6/2017 Kubik
2017/0330681 A1 11/2017 Kitagawa et al.
2018/0061569 A1 3/2018 Kubik et al.

FOREIGN PATENT DOCUMENTS

CN 1860564 A 11/2006
CN 103594221 A 2/2014
CN 204375745 U 6/2015
CN 104979080 A 10/2015
CN 105144317 A 12/2015
CN 205406254 U 7/2016
DE 103 54 694 A1 6/2005
DE 10 2016 123920 A1 6/2017
EP 0 902 445 A1 3/1999
EP 1 202 296 A1 5/2002
EP 1 873 759 A2 1/2008
EP 2 704 163 A2 3/2014
GB 725372 3/1955
JP 02142107 A 5/1990
JP H05182842 A 7/1993
JP 2001085419 A 3/2001
JP 2010515252 A 5/2010
JP 2017-199940 11/2017
KR 100761850 B1 9/2007
WO WO 98/56018 A2 12/1998

(56) References Cited

FOREIGN PATENT DOCUMENTS

OTHER PUBLICATIONS

Extended European Search Report dated Aug. 11, 2014 in connection with European Application No. 13181339.6.
Partial European Search Report dated Nov. 9, 2015 for European Patent Application No. 15174260.8.
Extended European Search Report dated Feb. 26, 2016 for European Patent Application No. 15174260.8.
European Examination Report dated Apr. 23, 2018 in connection with European Application No. 15174260.8.
Chinese Office Action dated Jul. 4, 2017 for Chinese Patent Application No. 2015103779271.1.
Harburg et al., Micro-fabricated thin-film inductors for on-chip power conversion. CIPS 2012. Mar. 6-8, 2012, Nuremberg, Germany. 6 pages.
Koh et al., High Frequency Microwave On-Chip Inductors Using Increased Ferromagnetic Resonance Frequency of Magnetic Films. 281h IEEE International Conference on MEMS 2015, Jan. 18-22, 2015, pp. 208-211.
Montgomery et al., Some Useful Information for the Design of Air-Core Solenoids. Unclassified AD 269073, Armed Services Technical Information Agency, 55 pages, Nov. 1961.
Montgomery, High-Strength Conductors For Supermagnets. IEEE Spectrum Magazine. Aug. 1966; 3(8):111-4.
Schaller, Ferrite Processing & Effects on Material Performance. Ceramic Magnetics, Inc. 16 Law Drive, Fairfield, NJ, pp. 87-90, undated, available at: http://www.cmi-ferrite.com/news/Articles/ferpro. pdf (accessed: Dec. 15, 2016).
Wang et al., High Efficiency on Si-Integrated Microtransformers for Isolated Power Conversion Applications. IEEE Transactions on Power Electronics. Oct. 2015;30(10):5746-54.
Weggel et al., Hybrid Magnets. Proc. 4th Int. Conf. Magn. Technol. 1972; pp. 18-28.
Wu et al., Improved High Frequency Response and Quality Factor of On-Chip Ferromagnetic Thin Film Inductors by Laminating and Patterning Co—Zr—Ta—B Films. IEEE Transactions on Magnetics. Jul. 2013; 49(7):4176-9.
Wu et al., Integrated RF On-Chip Inductors With Patterned Co—Zr—Ta—B Films. IEEE Transactions on Magnetics. Nov. 2012; (48)11:4123-6.
Xu et al., Performance Enhancement of On-Chip Inductors With Permalloy Magnetic Rings. IEEE Electron Device Letters. Jan. 2011;32(1):69-71.

* cited by examiner

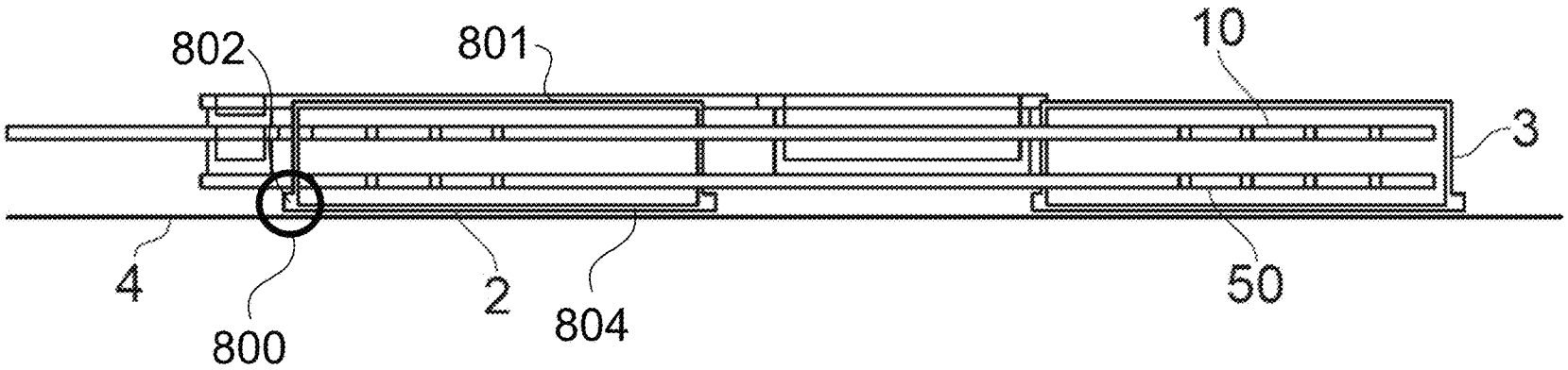
FIG. 15A
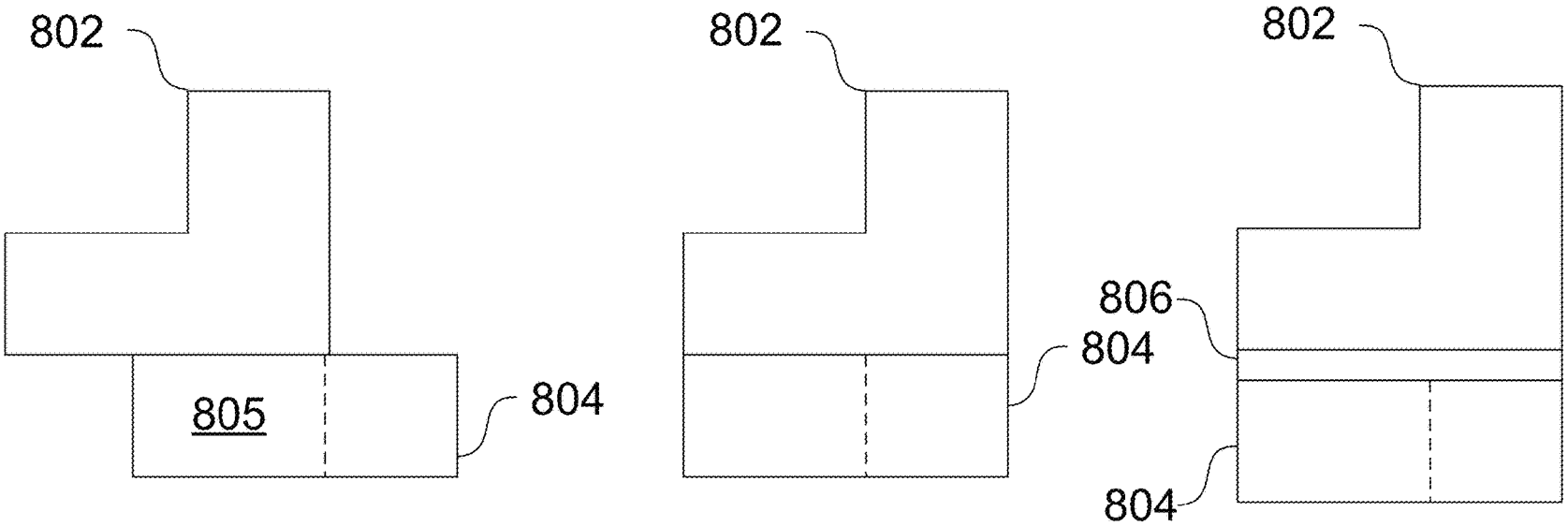
FIG. 15D
FIG. 15C
FIG. 15B

VIA FOR MAGNETIC CORE OF INDUCTIVE COMPONENT

CROSS-REFERENCES TO RELATED APPLICATIONS

The present application claims the benefit under 35 U.S.C. § 119(e) of U.S. Provisional Patent Application No. 62/517,777, filed Jun. 9, 2017, titled "Via for Magnetic Core of Inductive Component," which is hereby incorporated by reference in its entirety.

FIELD OF THE DISCLOSURE

The present disclosure relates to a magnetic core of an inductive component such as a transformer, and to integrated circuits including such a magnetic core.

BACKGROUND

Inductive components, such as inductors and transformers, have many uses. For example, inductors may be used in the fabrication of filters and resonant circuits, or may be used in switched mode power converters to boost or reduce an input voltage for generation of a different output voltage. Transformers may be used in the transfer of power or signals from one circuit to another while providing high levels of galvanic isolation.

Inductors and transformers can be fabricated within an integrated circuit environment. Spaced apart conductors generally forming a spiral or an approximation of a spiral can be formed on or within a semiconductor substrate to form a coil as part of an inductor or a transformer. Such spaced apart spiral inductors can be placed side by side or in a stacked configuration.

Inductive components can include a magnetic core within an integrated circuit. Performance of inductive components that include magnetic cores can be improved by reducing losses associated with magnetic cores.

SUMMARY OF THE DISCLOSURE

Techniques for fabricating low-loss magnetic vias within a magnetic core are provided. According to some embodiments, vias with small, well-defined sizes may be fabricated without reliance on precise alignment of layers. According to some embodiments, a magnetic core including a low-loss magnetic via can be wrapped around conductive coils of an inductor. The low-loss magnetic vias can improve performance of an inductive component by improving the quality factor relative to higher loss magnetic vias.

According to some aspects, a magnetic core of an integrated circuit is provided, the magnetic core comprising a first layer of the magnetic core, a second layer of the magnetic core, wherein the first layer and the second layer of the magnetic core each comprise layers of magnetic material and at least one lamination layer, and a via magnetically coupling the first layer to the second layer, wherein the via extends through an insulating layer.

According to some aspects, a transformer for transferring power and providing galvanic isolation is provided, the transformer comprising a primary coil and a secondary coil, and a magnetic core comprising a first layer of the magnetic core, a second layer of the magnetic core, and a via coupling the first layer of the magnetic core to the second layer of the magnetic core, wherein at least a portion of the primary coil, at least a portion of the secondary coil, and insulation layers are disposed between the first layer and the second layer, and wherein the via passes through a separation layer to provide a pathway for magnetic flux between the first layer and the second layer, wherein the separation layer is between the first layer and the second layer on opposing sides of the via, and wherein the separation layer is thinner than a combination of thicknesses of the portion of the primary coil, the portion of the secondary coil, and the insulating layers.

According to some aspects, a transformer for transferring power and providing galvanic isolation is provided, the transformer comprising an upper layer of a magnetic core, a lower layer of the magnetic core, a first conductor coil at least part of which is arranged between the upper layer and the lower layer, a second conductor coil at least part of which is arranged between the upper layer and the lower layer, and a via comprising magnetic material, the via providing a pathway for magnetic flux.

The foregoing apparatus and method embodiments may be implemented with any suitable combination of aspects, features, and acts described above or in further detail below. These and other aspects, embodiments, and features of the present teachings can be more fully understood from the following description in conjunction with the accompanying drawings.

BRIEF DESCRIPTION OF THE DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

FIG. 15A depicts a cross section through an illustrative transformer, according to some embodiments;

FIGS. 15B, 15C, and 15D are zoomed-in illustrations showing examples of the contact base in FIG. 15A;

DETAILED DESCRIPTION

Figure 1:
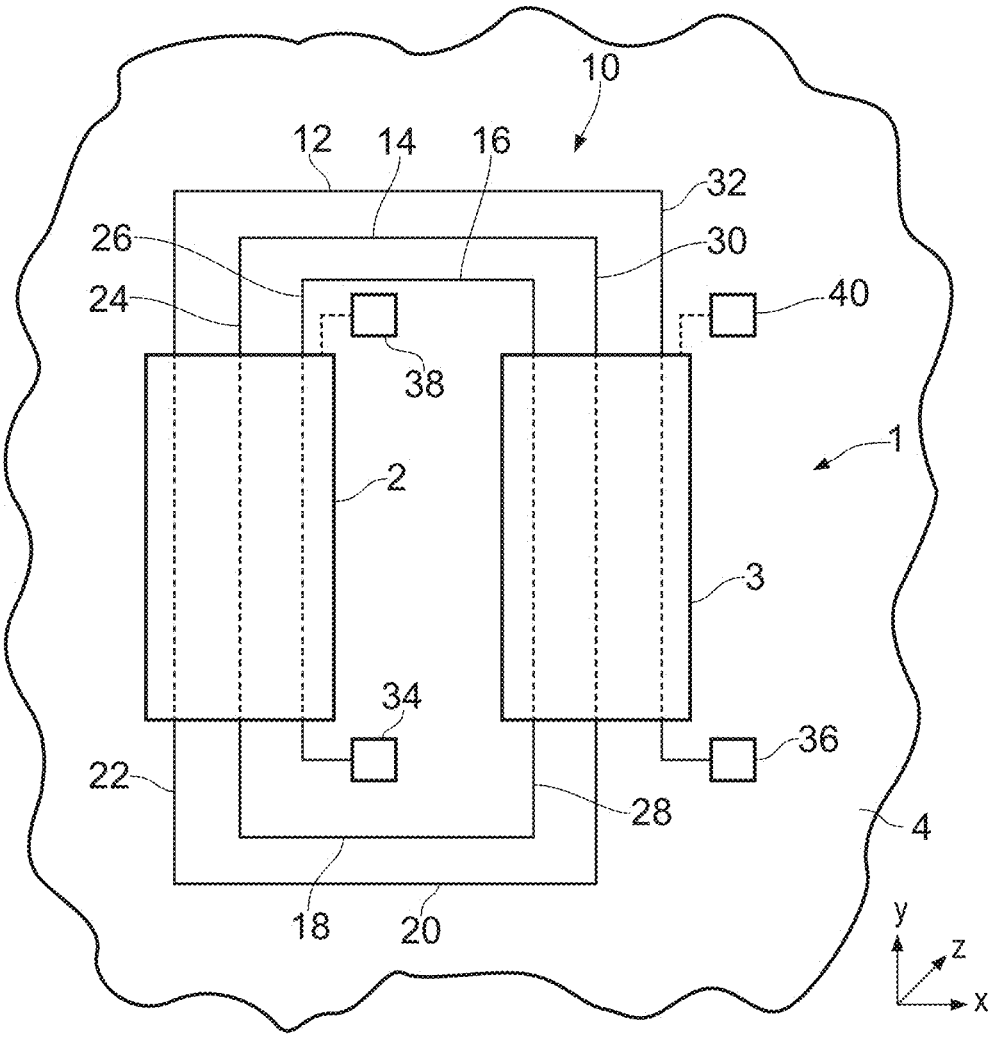
FIG. 1 is a schematic plan view of an illustrative transformer, according to some embodiments.

Magnetic cores are utilized in various devices including electromagnets, transformers, electric motors and inductors. A magnetic core comprises magnetic material (e.g., a ferromagnetic metal) used to confine and guide a magnetic field. In some devices, such as transformers, a magnetic core may be subjected to a changing magnetic field. This configuration may cause power to be lost in the core because the changing magnetic field may produce electrical currents within the core due to electromagnetic induction. These induced currents are referred to as eddy currents.

In integrated circuits, magnetic cores are typically fabricated by forming one or more layers of magnetic material above and below other components so that magnetic flux may flow around the components. For instance, in a transformer, a conductive track may be arranged within the interior of a magnetic core by forming layers of magnetic material around the track. In devices where two separate layers of magnetic material are formed to produce a single magnetic core, losses can occur at the interface between these layers. In particular, as the size of the contact area between the layers, also referred to as the via, increases, eddy current losses in and/or around the via tend to increase. There are, however, numerous challenges involved in fabricating magnetic cores with small vias. For instance, as vias become smaller, the precision necessary to correctly align a plurality of layers increase. In cases where layers are incorrectly aligned with one another, air gaps may be created between magnetic layers, inhibiting magnetic flux from traveling around the core materials.

The inventors have recognized techniques for fabricating low-loss magnetic vias within a magnetic core. In particular, the inventors have recognized techniques for producing vias with small, well-defined sizes. According to some aspects, these techniques do not rely on precise alignment of a number of layers as with conventional approaches. According to some embodiments, a magnetic core can be formed around conductive coils of an inductor. The low-loss magnetic vias can improve performance of an inductive component by improving the quality factor (Q factor) relative to higher loss magnetic vias.

This disclosure also provides a compensation structure to compensate for core saturation non-uniformity of a magnetic core. This structure may include a coil in which the turns density varies across the coil. Turns density may be defined as the number of turns per unit length. By increasing the width of the conductors forming the coil, the turns density may be decreased. Turns density may be varied by having conductors of different thicknesses for each turn of the coil. It is thus possible to provide a magnetic component on or as part of an integrated circuit where the magnetic core saturates more uniformly. This can in turn give rise to greater linearity and improved power transfer within an operating region where substantially none of the core has reached magnetic saturation. This can be achieved without incurring an increased footprint for the magnetic component on a substrate, such as a semiconductor, on which the magnetic component is carried.

FIG. 1 schematically illustrates an example of a transformer 1. The transformer 1 includes two magnetic cores. A first magnetic core is generally indicated by reference number 2 and a second magnetic core is generally indicated by reference number 3. The magnetic cores are formed as rectangular tubes in which the transformer coils are positioned, as will be explained in more detail below. The first and second magnetic cores 2, 3 are formed above a portion of a substrate 4. Advantageously the substrate 4 can be a semiconductor substrate (e.g., a silicon substrate) such that other components, such as drive circuitry and receiver circuitry associated with primary and secondary windings of the transformer 1, may be formed on the substrate 4 and/or on physically separate substrates within the same integrated circuit package. However, in some applications the substrate 4 may comprise non-semiconductor substrate materials, which may be advantageous for their electrical properties such as higher impedance. Such non-semiconductor substrates can be implemented in accordance with any suitable principles and advantages discussed herein.

The transformer 1 includes two coils or windings. In FIG. 1, a primary winding 10 is shown. The primary winding 10 is formed from conductive tracks which are formed over the substrate 4. The primary winding 10 is formed from linear track sections 12, 14, 16, 18, 20, 22, 24, 26, 28, 30 and 32. Linear track sections 12, 14, 16, 18 and 20 are substantially parallel to each other and are formed in the X-direction. Linear track sections 22, 24, 26, 28, 30 and 32 are substantially parallel to each other and are formed in the Y-direction. The X-direction track sections are substantially perpendicular to the Y-direction track sections. The linear track sections are connected at their ends as shown in FIG. 1 in order to form the primary winding 10. The illustrated linear track sections are formed from a first metallic layer. At either end of the primary coil 10, connection pads 34, 36 are formed to enable connection of the transformer 1 to other components. A secondary winding (most of which is not shown in FIG. 1) may be formed from further linear track sections in a second metallic layer below the first metallic layer. These sections are not shown in FIG. 1 as they are formed below the track sections of the primary winding 10. However, the ends of the secondary coil have connection pads 38, 40, which may be seen in FIG. 1.

In the example of FIG. 1, the primary and secondary windings are formed as planar spirals. The spiral of the primary winding 10 is in the same plane as the plane formed by the X and Y axes. The primary and secondary windings are insulated from the first and second magnetic cores 2, 3, and are insulated from one another. Thus there is no galvanic path between the primary winding 10 and the secondary winding, and the primary mechanism coupling the coils together is a magnetic one. Minor parasitic capacitances may also form signal flow paths between the primary and secondary windings, but these are considerably less significant. The Z-direction in FIG. 1 is parallel to the coil axes.

Figure 2:
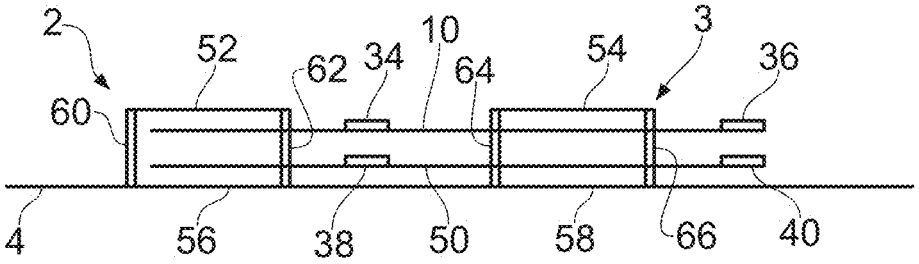
FIG. 2 is a schematic cross section through the transformer of FIG. 1.

FIG. 2 is an end view of the transformer 1. In this Figure, the secondary winding 50 is shown. This figure shows more clearly the first and second metallic layers of the primary and secondary windings 10, 50. Also shown are the connection pads 34, 36, 38 and 40. The first and second metallic layers are formed substantially parallel to the substrate 4. FIG. 2 also shows further details of the first and second magnetic cores 2, 3. Each core is formed from an upper magnetic layer 52, 54 and a lower magnetic layer 56, 58. These layers are illustrated as being rectangular in shape, and are substantially parallel to the substrate 4 and the first and second metallic layers. Each core 2, 3 extends beyond the edge of the outer and inner linear track of the primary and secondary windings 10, 50. The longer edges of the upper and lower magnetic layers are connected by vias 60, 62, 64 and 66 which are formed from magnetic material. As such, each core 2, 3 forms a rectangular tube through which the primary and secondary windings 10, 50 are formed.

In the above example, the magnetic vias 60, 62, 64, 66 also connect the upper 52, 54 and lower 56, 58 magnetic layers. In an alternative example, the vias may not completely bridge the space between the layers. Instead, a gap may be formed between the vias and, for example, the lower layer. This gap may be formed by providing a layer of insulating material between the ends of the vias and the lower layer using a material such as oxide, nitride or polyimide. The gap may be in the range of 10 nm to 500 nm. A benefit of such an arrangement is that an area of relatively high reluctance is formed in the core. This reduces permeability and helps reduce and/or prevent premature saturation.

In the above example, the planar nature of the coils give them the appearance of a racetrack, when viewed from above. Accordingly, transformer 1 may be referred to as a racetrack transformer.

For the purposes of illustration, structures around the magnetic cores 2, 3 such as layers of insulating material, for example polyimide, have been omitted. Thus the structures shown in FIGS. 1 and 2 are the substrate 4, the first and second magnetic cores 2, 3, and conductive tracks that form the primary and secondary windings 10, 50.

Figure 3:
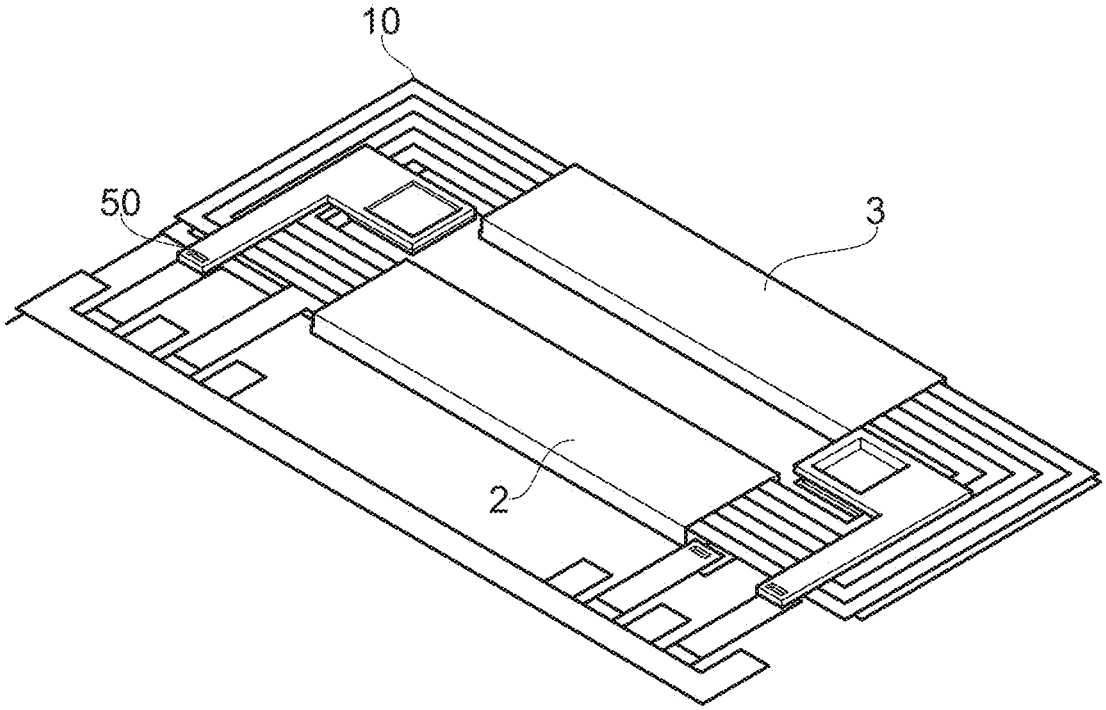
FIG. 3 is a perspective view of an illustrative transformer formed within an integrated circuit, according to some embodiments.
Figure 4:
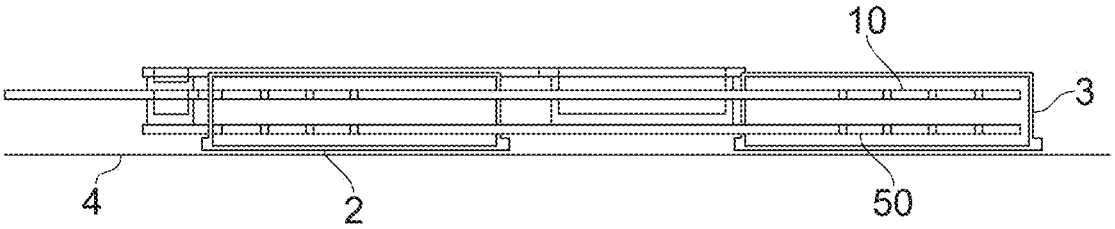
FIG. 4 is a cross section through the transformer of FIG. 3.

FIGS. 3 and 4 respectively show a perspective view and end view of a transformer of the type shown in FIGS. 1 and 2, as can be formed on an integrated circuit. It can be seen that the primary winding 10 and the secondary winding 50 spiral their way between the magnetic cores 2 and 3. In the illustrative transformer shown in FIGS. 3 and 4, the width of each conductor forming a winding is uniform, as is the space between adjacent windings or conductors in either of the metallic layers of conductors. Generally speaking, the space between adjacent conductors in a layer can be substantially reduced, consistent with reducing the Ohmic resistance of the coil, while giving sufficient spacing to avoid shorting between coil turns as a result of manufacturing defects. The illustrated uniform windings can increase and/or maximize the number of turns for a given occupied area.

When forming a device, such as a transformer, the saturation current, being the maximum current which can be passed through the primary winding of the transformer before magnetic core saturation occurs, is a property of the transformer and its ferromagnetic core and is linked to the total power rating of the transformer. Therefore maximizing the saturation current and the power transfer of a given size transformer can be highly desirable.

A magnetic material can support a certain magnetic flux before it becomes magnetically saturated and its relative permeability drops, in some cases dramatically (if the material is fully saturated then its permeability drops to 1). The relative permeability in combination with turns density of the coil and the saturation flux density determine device saturation current.

The inventors have recognized that the magnetic field drops towards the edges of the sections of the windings 10, 50 passing through the cores 2, 3. In addition, a demagnetizing field creates a magnetic field that is internal to the body of the core, and which acts in an opposite direction to the applied field from the coil. The demagnetizing field is strongest towards the long edges of the cores 2, 3. The spatial variation of demagnetizing field can be described in terms of spatial variation of the relative permeability. Because the demagnetizing field gets stronger towards the long edges of the core, the relative permeability drops towards the long edges and it takes higher current to magnetically saturate the long edges of the core than the center of the core.

In general terms, as windings 10, 50 get narrower, the demagnetizing field gets stronger. Also, the magnetic fields, both applied and demagnetizing, exist in three dimensions. Thus, although the magnetic cores are essentially planar they can experience some fields at their ends which are out of the plane of the planar core. This gives rise to different internal field strengths as a function of position within the magnetic core.

The inventors have recognized that, as a result of these factors, a ferromagnetic transformer core may suffer from early saturation of the central core area due to the uneven distribution of the magnetic flux density within the core. This onset of saturation, which grows in spatial extent as the bias current is increased, can introduce early non-ideal behavior of the transformer and can therefore limit the available saturation current.

Figure 5:
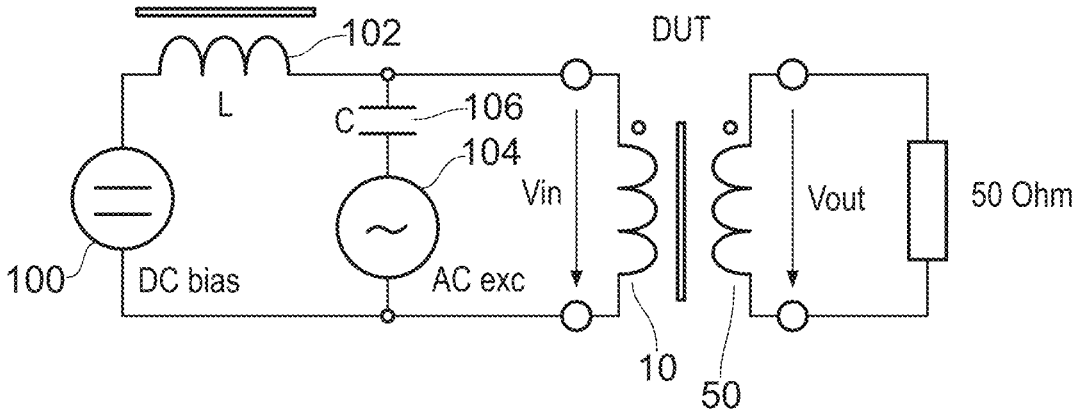
FIG. 5 is a circuit diagram showing a circuit for measuring flux density as a function of coil current, according to some embodiments.

FIG. 5 shows an apparatus that can be used to measure the performance of the transformer. As shown, a direct current (DC) current bias 100, which could be a current source, is used to impose a DC current through the primary winding 10 of a transformer. An inductor 102 is typically included in series with the DC bias source 100 in order to present a high impedance to alternating current (AC) signals. An AC signal generator 104 in series with a DC blocking capacitor 106 is used to superimpose an AC signal onto the DC bias. The voltage appearing across the output of the secondary winding 50 is then measured, and then compared with the voltage provided by the AC excitation source 104. This allows the instantaneous AC power transfer of the transformer to be measured as a function of the DC bias current.

Figure 6:
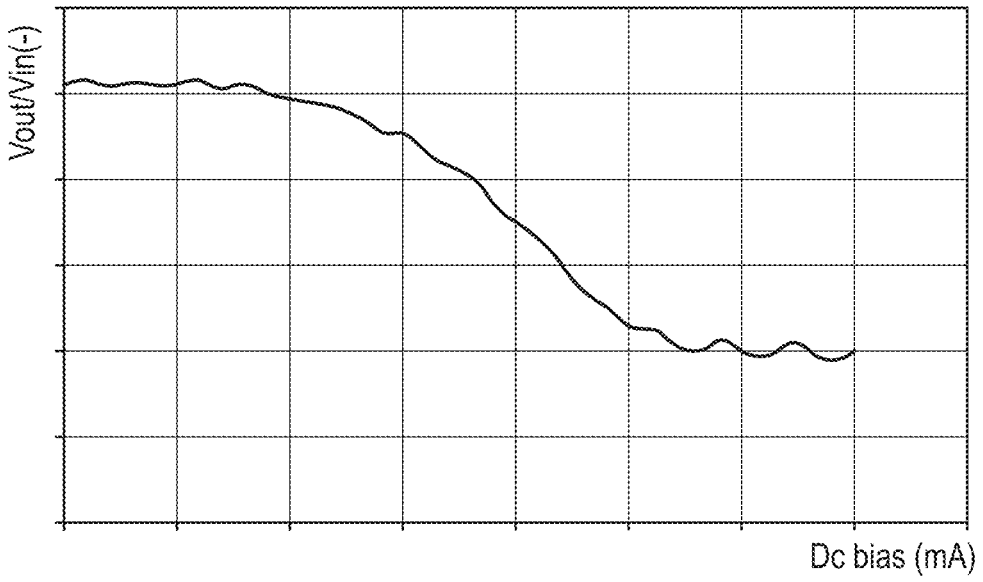
FIG. 6 shows a graph of flux density versus coil current for a transformer, according to some embodiments.

A graph illustrating measurement of this relationship is shown in FIG. 6 for a transformer with uniform windings. It can be seen that, at relatively low bias currents the ratio of a Vout to Vin is relatively high, and can be regarded as operating the transformer in a region where its core is not saturated. Therefore the effective permeability to a small change in primary current is representative of a high value of the relative permeability $\mu_r$. Conversely, when the DC bias current becomes relatively large and the core is fully saturated, the output reduces to a smaller value, which is more akin to that of an air core transformer as the ferromagnetic core can no longer provide enhancement of the flux density as a result of a small change in the current.

Figure 7:
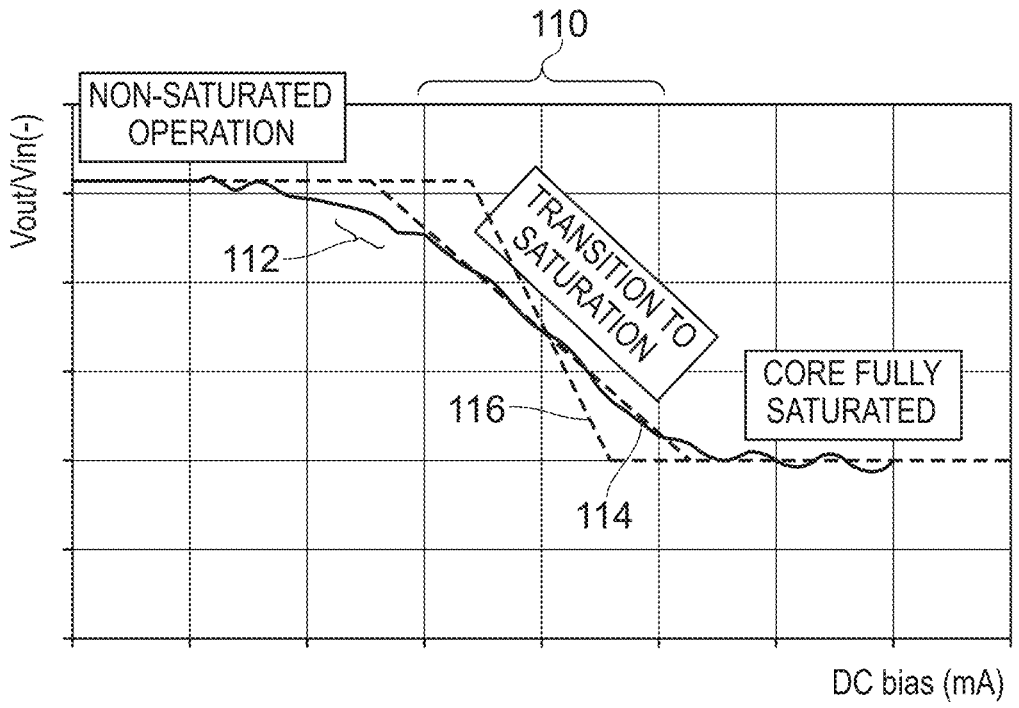
FIG. 7 shows a graph of flux density versus coil current for an optimized transformer, according to some embodiments.

FIG. 7 re-plots the data of FIG. 6 to label the saturated and non-saturated regions, and also to apply straight line approximations to sections of the graph. Between the non-saturated region and the fully saturated region is a transition region, labeled 110 in FIG. 7, where the permeability transitions from the non-saturated to the fully saturated values. Mathematical modelling indicates that the flux density B within the ferromagnetic core is non-uniform and is weaker at the edges or ends of the core, and more intense towards the center of the core. As a result, as the DC bias current increases the central portion of the core starts to saturate, indicated in FIG. 7 by the point at which the ratio starts to degrade around the area of the graph generally designated 112. The area of saturation then continues to grow from the middle to the ends until the core becomes fully saturated.

Preferably, the core transition to saturated state would start with higher bias current and it would transition more abruptly from non-saturated operation to saturated operation. This would enable a given size of magnetic core to handle more power and current before saturation occurs, although its performance would then degrade much more rapidly.

The inventors have recognized techniques to reduce the tendency of the central section of the magnetic core to saturate earlier than the edge sections of the magnetic core. In particular, these techniques may comprise varying the turns density of the coil as a function of distance radially across the plane of the windings (e.g., the X-direction in FIG. 1). The result of these techniques are show in the example of FIG. 7. In FIG. 7, the dashed line 114 illustrates the magnetic saturation behavior of a coil with constant turns density, whereas dashed line 116 illustrates the expected magnetic saturation behavior of a coil with a varied and/or optimized turns density.

Figure 8:
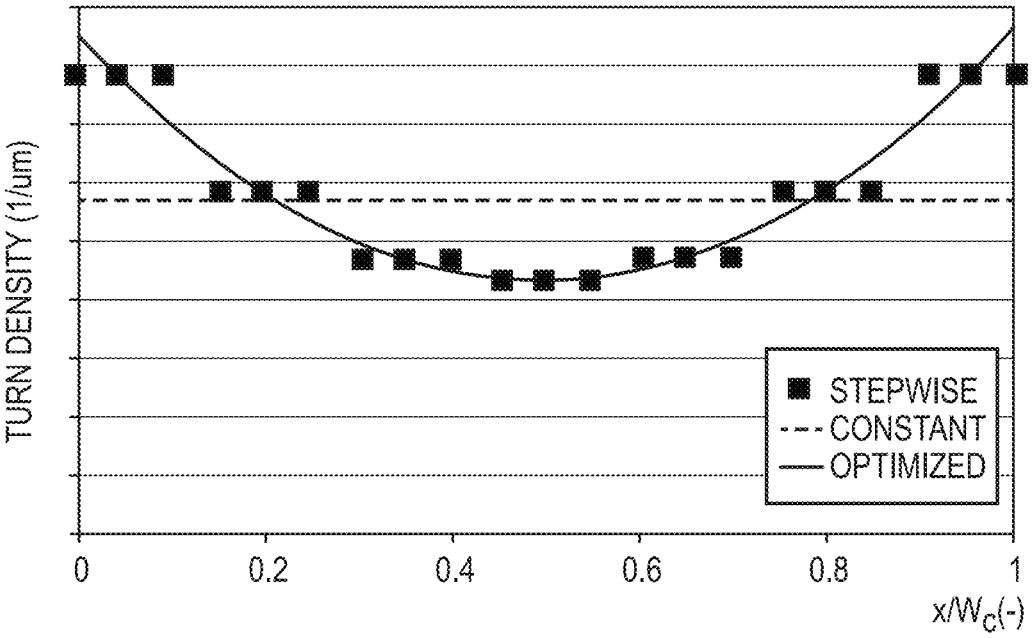
FIG. 8 is a graph representing turns density as a function of position along a coil axis for a coil surrounding a magnetic core, according to some embodiments.

As one illustrative example of how the turns density of the coil may be varied as a function of distance, FIG. 8 is a graph schematically illustrating variation of turns density as a function of distance in the X-direction across the core 2 having a width of one arbitrary unit Wc. It can be seen that the turns density can be increased towards the edges of the core, as represented by values of x=0 and x=1, and decreased towards the center of the core, in order to reduce the tendency for early saturation of the central section. According to some embodiments, a coil having a varying turns density such as illustrated by the solid line in FIG. 8 may exhibit magnetic saturation behavior shown as dashed line 116 in FIG. 7, whereas a coil having a constant turns density as illustrated by the dashed line in FIG. 8 may exhibit magnetic saturation behavior shown as dashed line 114 in FIG. 7.

The dimensions of a coil within a magnetic core within an integrated circuit are quite compact, and it is therefore unlikely that the turns would be modified in a smoothly varying manner represented by the optimized curve in FIG. 8, but a step wise approximation is possible as shown in FIG. 8.

Figure 9:
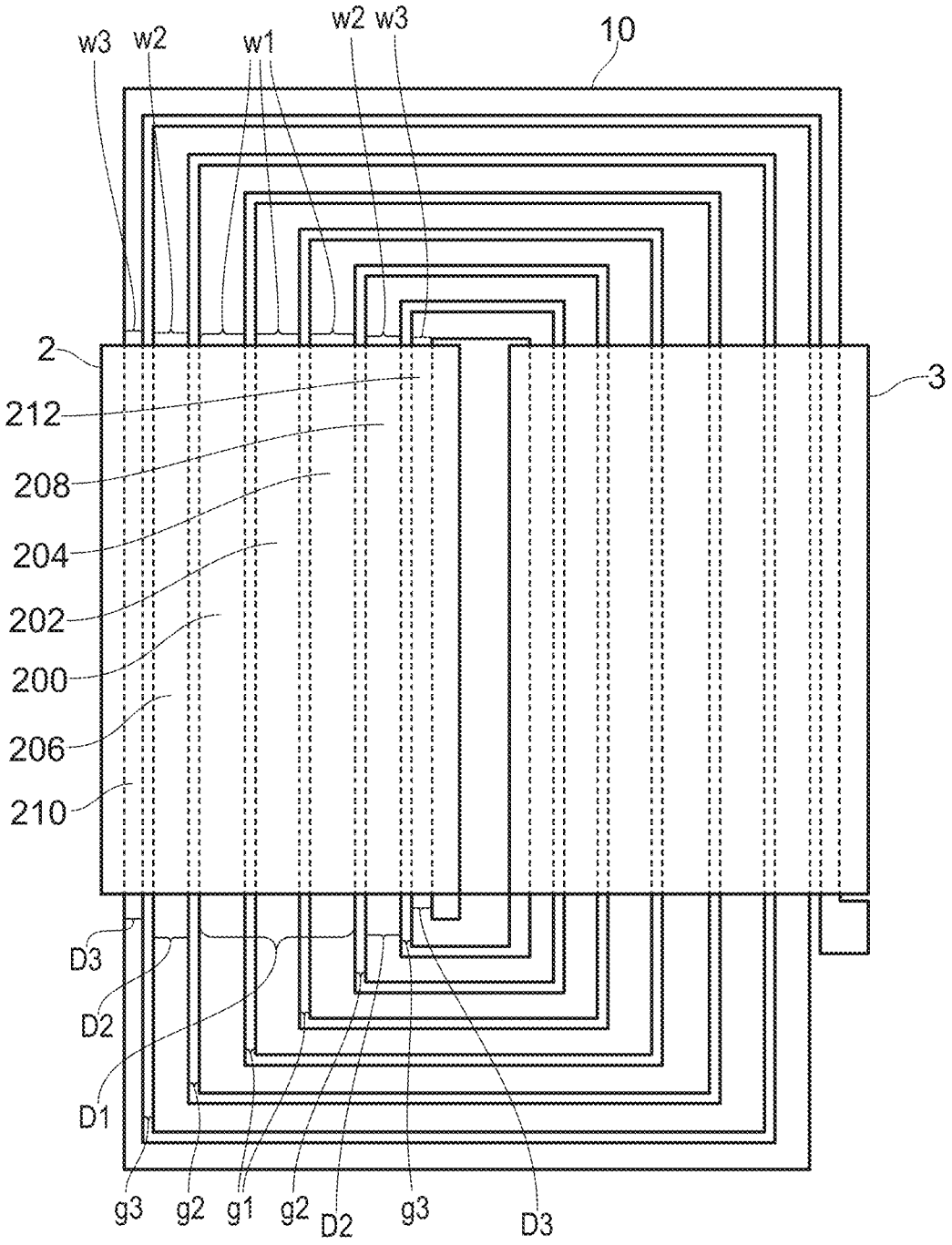
FIG. 9 is a schematic view of an inductor or transformer in accordance, according to some embodiments.

As a result of applying a step wise approximation to the turns density, a winding density as shown in FIG. 9 may be achieved where the coil may comprise spaced apart conductors, of which the primary winding 10 is shown, but a corresponding pattern can also be formed on the secondary winding 50 beneath the primary winding 10. The conductor strips are arranged to give a coil having a relatively low winding density, designated density D1, towards a central portion of the coil, and an intermediate winding density, designated density D2, on either side of the area at the center of the coil. Either edge of the coil has a higher winding density, designated density D3, compared to the central and intermediate densities. In the illustrated embodiment, differing densities are achieved by varying the conductor widths at different sections of the coil. The first section of the coil comprises relatively wide strips of conducting material designated 200, 202 and 204 having a width w1 and an inter-conductor gap distance g1. The intermediate areas of coil density, density D2, are comprised of conductors 206 and 208 having a conductor width w2 and an inter conductor gap spacing g2. The end portions having the highest winding density, density D3, are comprised of conductors 210 and 212, having a width to w3 and an inter conductor spacing g3. As such, the coil is a compensation structure that compensates for core saturation non-uniformity of the magnetic core.

According to some embodiments, the gap between the conductors may be varied whilst keeping the conductor width the same such that w1=w2=w3 and g3>g2>g1. However this arrangement, while giving generally desirable magnetic properties, can give rise to an increase in resistance of the coil compared to that which could be obtained by keeping the gap between the adjacent conductors the same, such that g1=g2=g3, and then varying the relative width of the conductive elements w1, w2 and w3 such that w1>w2>w3. According to some embodiments, varying the widths of the conductors forming the coils, rather than varying the dielectric gaps, may increase and/or maximize the amount of conductor (for a given thickness of conductor) involved in carrying the current through the coil, and may thereby reduce the resistance of the coil.

As an alternative to the example of FIG. 9, the compensation structure may include the core itself. For example, the length of the core (in the Y-direction in FIG. 1) may vary across the core (in the X-direction in FIG. 1). As such, the length of the core at the edges of the core in the area adjacent the inner and outer conductors 210, 212 is shorter than the length of the core in the area adjacent the inner conductors 200, 202, 204. Such an arrangement may compensate for core saturation non-uniformity in a similar way to varying the turns density of the coil.

As discussed above, the inventors have recognized techniques for fabricating low-loss magnetic vias within a magnetic core. In particular, the inventors have recognized techniques for producing vias with small, well-defined sizes that do not rely on precise alignment of a number of layers as in conventional approaches. An illustrative integrated circuit including a transformer having a magnetic core is illustrated in FIG. 10.

Figure 10:
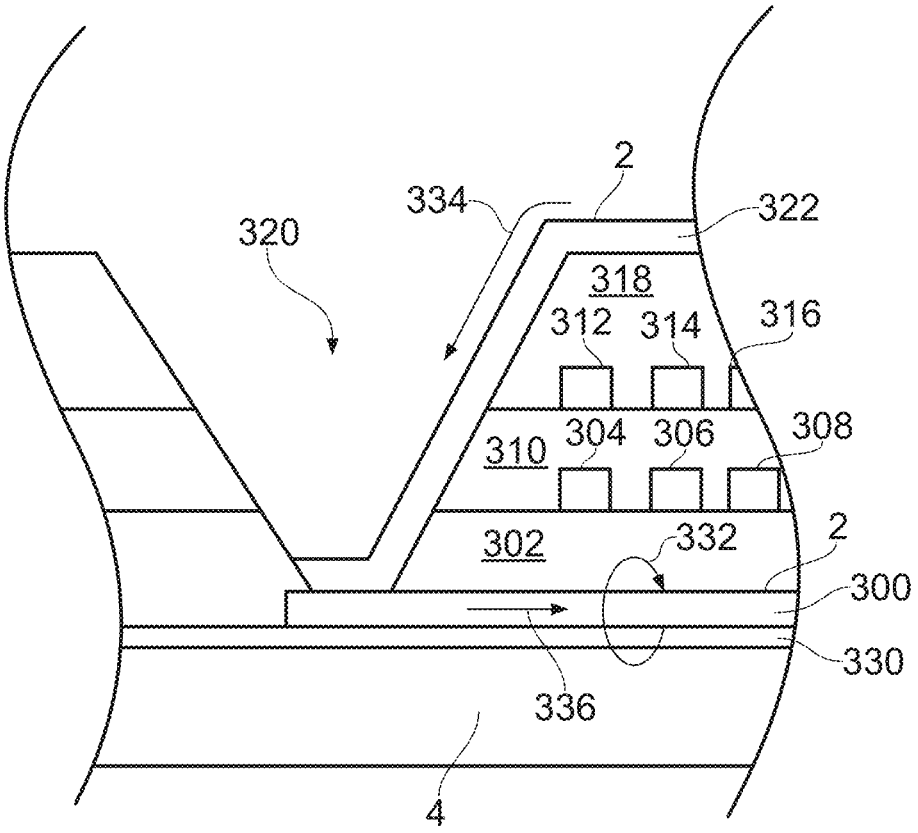
FIG. 10 is a schematic cross section through an illustrative integrated circuit device.

FIG. 10 is a schematic cross-section through an integrated circuit including a transformer having a magnetic core. As shown in FIG. 10, the integrated circuit comprises a substrate 4 which has a lowermost magnetic layer 300 deposited thereon. After deposition, a magnetic layer is masked and etched so as to form a lower layer 300 of the magnetic core 2. An upper layer 322 of the core is formed over other components, including windings 304, 306, 308 of the secondary coil and windings 312, 314, 316 of the primary coil.

As discussed above, it has proven difficult to manufacture low-loss magnetic vias, in which such magnetic vias provide connections between top and bottom parts of a magnetic core in an integrated inductor or transformer. One reason for this difficultly is that narrower vias can have lower losses, but due to manufacturing limitations, magnetic vias have been made wide to make sure there is sufficient overlap between top and bottom core in case of layer misalignment. For example, in the illustrative transformer shown in FIG. 10, layer 322 would ideally be deposited over the other layers so as produce a small contact area between the magnetic layer 322 and the magnetic layer 300. As the contact area becomes larger, eddy currents within the contact region may increase and negatively impact the ability of magnetic flux to flow around the core. This contact region is highlighted as region 1602 in FIG. 25.

The inventors have recognized techniques for creating relatively small, relatively narrow and thus low-loss magnetic vias. Such vias can utilize an insulation layer with defined narrow openings that form magnetic vias while allowing for gross misalignment in defining of the magnetic cores. Accordingly, this can provide a racetrack magnetic core transformer or inductor with low-loss magnetic vias connecting two layers of magnetic core wrapping around conductors and methods for forming the same.

Figure 21A:
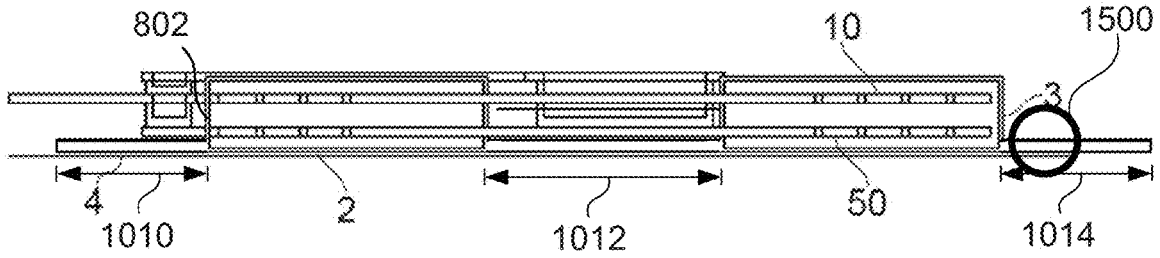
FIG. 21A shows a cross section of an illustrative transformer with the contact base shown in FIG. 21B, according to some embodiments.
Figure 21B:
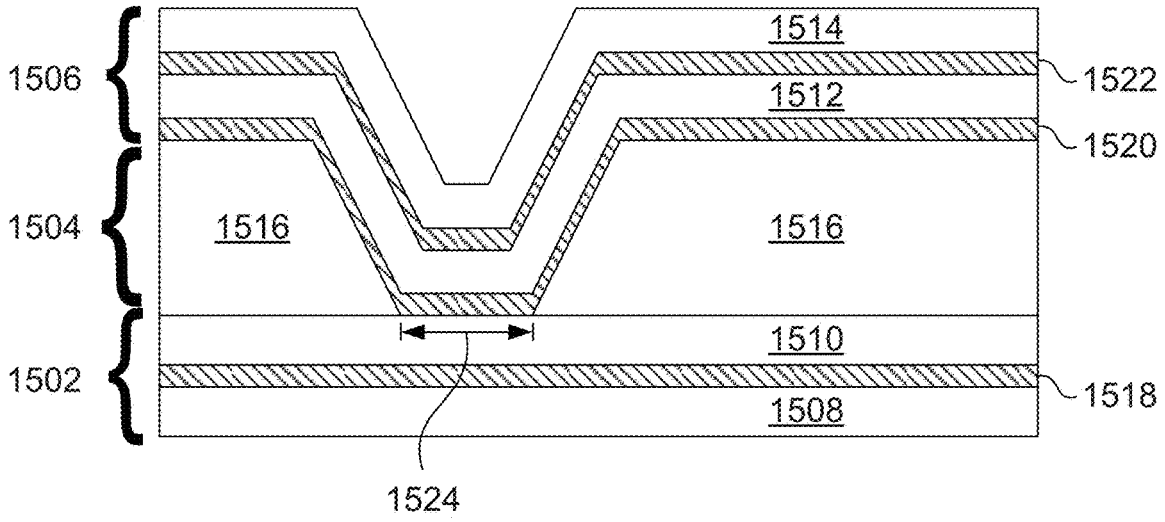
FIG. 21B shows details of a contact base included in FIG. 21A.

FIG. 21B depicts an illustrative example of a low-loss magnetic via, according to some embodiments. The region of a magnetic core shown in FIG. 21B may correspond to the region of contact between two magnetic layers of a magnetic core, such as region 1602 highlighted in FIG. 25. An insulating or separation layer 1504 is formed over a first magnetic layer 1502, and a second magnetic layer 1506 is formed over both layers 1502 and 1504, thereby forming a via 1524 between the two magnetic layers of the core. In the example of FIG. 21B, the first magnetic layer 1502 includes a layer of magnetic material 1508, a lamination layer 1518, and a layer of magnetic material 1510; and the second magnetic layer 1506 includes a lamination layer 1520, a layer of magnetic material 1512, a lamination layer 1522, and a layer of magnetic material 1514. The lamination layers 1518, 1520 and 1522 can include insulating material so that eddy currents are reduced within the interior of the magnetic layers. Techniques for fabricating the low-loss magnetic via of FIG. 21B are described further below in relation to FIGS. 24A-24F.

Returning to the illustrative transformer of FIG. 25, the elements within the magnetic core may be fabricated as follows. An insulating layer 302, for example of polyimide, is deposited above the magnetic layer 300 to insulate the magnetic core from the transformer windings. The windings 304, 306, 308 of the secondary coil 50 are then deposited, for example by electroplating across the entirety of the substrate. The structure is then masked and then etched so as to form isolated metallic coil regions above the insulating layer 302. Additional insulating material may then be deposited to fill in the gaps between adjacent coils to encapsulate them within a dielectric. Such an insulating layer is designated as 310 in FIG. 25. The windings 312, 314, 316 of the primary coil 10 are then deposited, for example by electroplating across the entirety of the substrate. The structure is then masked and then etched so as to form isolated metallic coil regions above the insulating layer 310. Additional insulating material may then be deposited to fill in the gaps between adjacent coils to encapsulate them within a dielectric. Such an insulating layer is designated as 318 in FIG. 25.

The insulating layer 318 may then be subject to planarizing in order to form a substantially flat upper surface of the integrated circuit. As each layer of insulator is fabricated, its surface may be masked, using a material such as polyimide, and can be etched in order to form a gap in each of the insulating layers 302, 310, 318. Once all of the layers have been fabricated, the gaps can form depression 320 which extends down to the lowermost magnetic layer 300. The upper surface of insulating layer 318 may then have a magnetic layer 322 deposited on it. The magnetic layer can also be deposited into the V-shaped depression 320 thereby forming a connection between the lowermost magnetic layer 300 and the uppermost magnetic layer 322. The layer 322 can then be masked and etched in order to form, amongst other things, the upper portion of the core 2.

The lowermost magnetic layer 300 may be formed over an insulating layer 330, for example of silicon dioxide or any other suitable dielectric material, which may itself overlie various semiconductor devices (not shown) formed by implantation of donor or acceptor impurities into the substrate 4. As known to the person skilled in the art, apertures may be formed in the insulating layers 302, 310, 318 in order to form device interconnections among the various circuit components.

Each layer of the magnetic core 300, 322 may comprise a plurality of sub-layers. For example, each layer may include four sub-layers. The magnetic core 2 may also comprise a plurality of first insulating layers arranged in an alternating sequence with sub-layers of magnetically functional material. In this example, four layers of insulating material sit above the four sub-layers of magnetic material in an alternating stack. It should be noted that fewer, or indeed more, layers of magnetically functional material and insulating material may be used to form the core 2. Magnetic core 3 is formed in the similar manner. These sub-layers can help prevent, or reduce, the build-up of eddy currents.

The sub-layers of the insulating material may be aluminum nitride (although other insulating materials such as aluminum oxide may be used for some or all of the layers of insulating material), and may have thicknesses in the range of 3 to 20 nanometers. The magnetically active layers can be formed of nickel iron, nickel cobalt or composites of cobalt or iron with one or more of the elements zirconium, niobium, tantalum and boron. The magnetically active layers may typically have a thickness in the range of 50 to 300 nanometers. Magnetic flux flows around the core 2 in the direction shown by arrows 334 and 336. As such, eddy currents that move in the direction indicated by arrow 332 are significantly reduced by the above-described sub-layers. This is because the sub-layers are formed substantially perpendicular to the direction of flow of at least a part of the eddy current flow-path.

Figure 11:
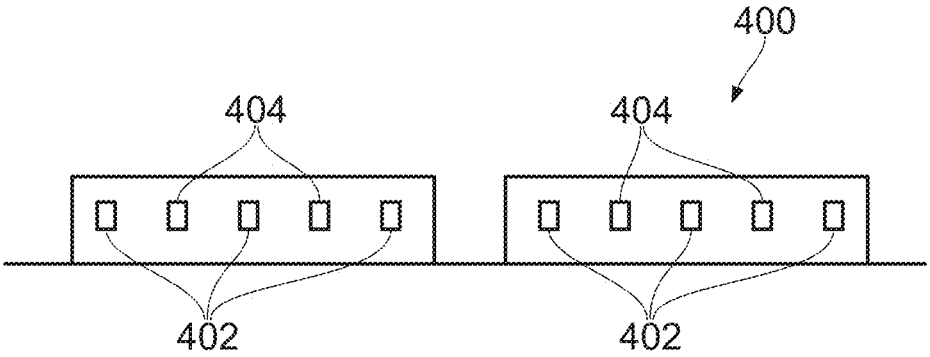
FIG. 11 is a schematic cross section through a transformer, according to some embodiments.
Figure 12:
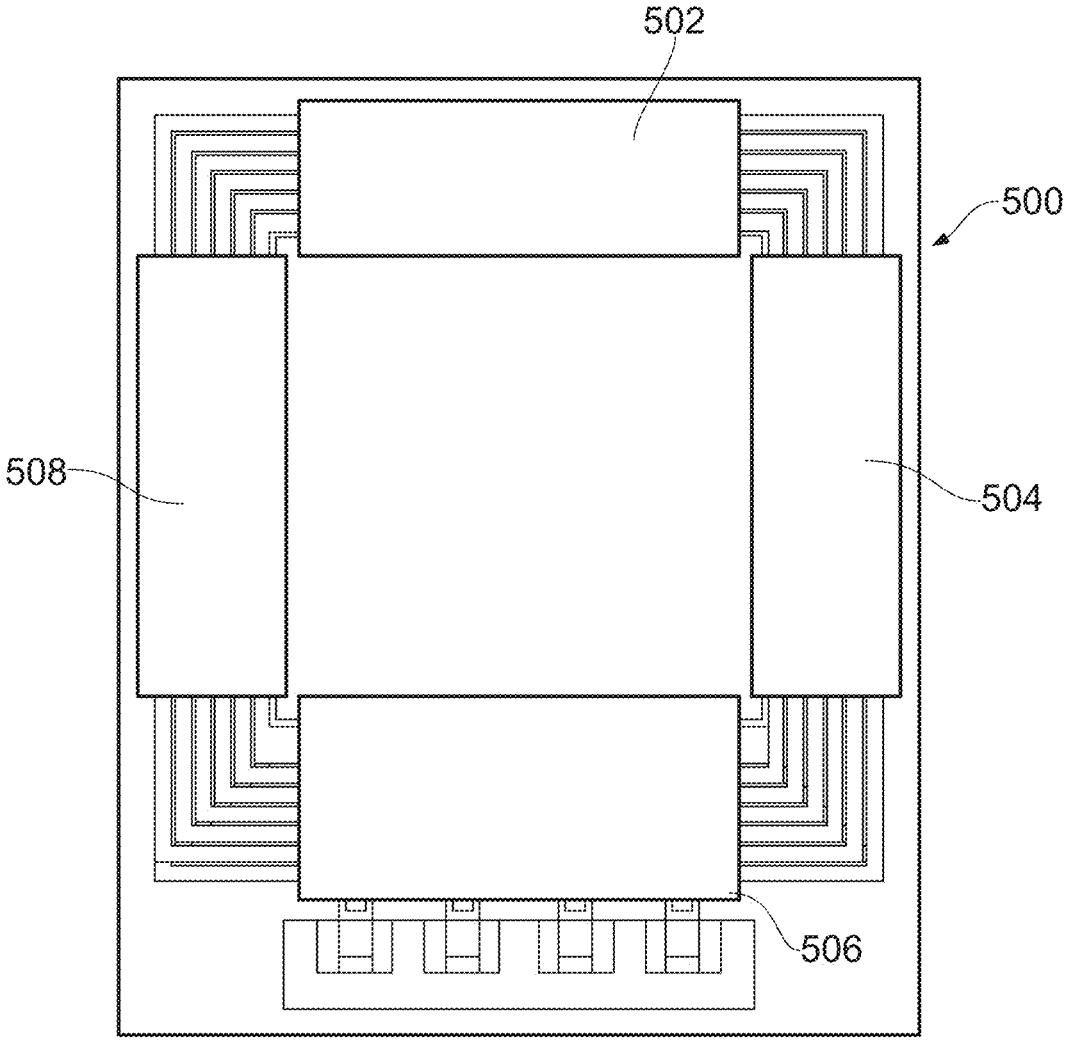
FIG. 12 is a schematic plan view of a transformer, according to some embodiments.
Figure 13:
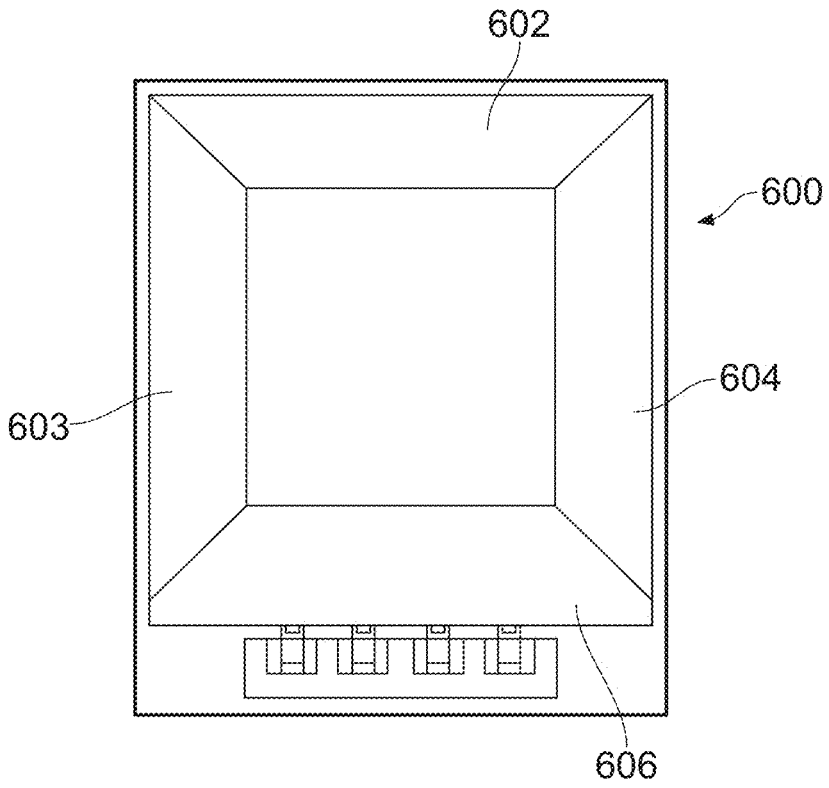
FIG. 13 is a schematic plan view of a transformer, according to some embodiments.
Figure 14:
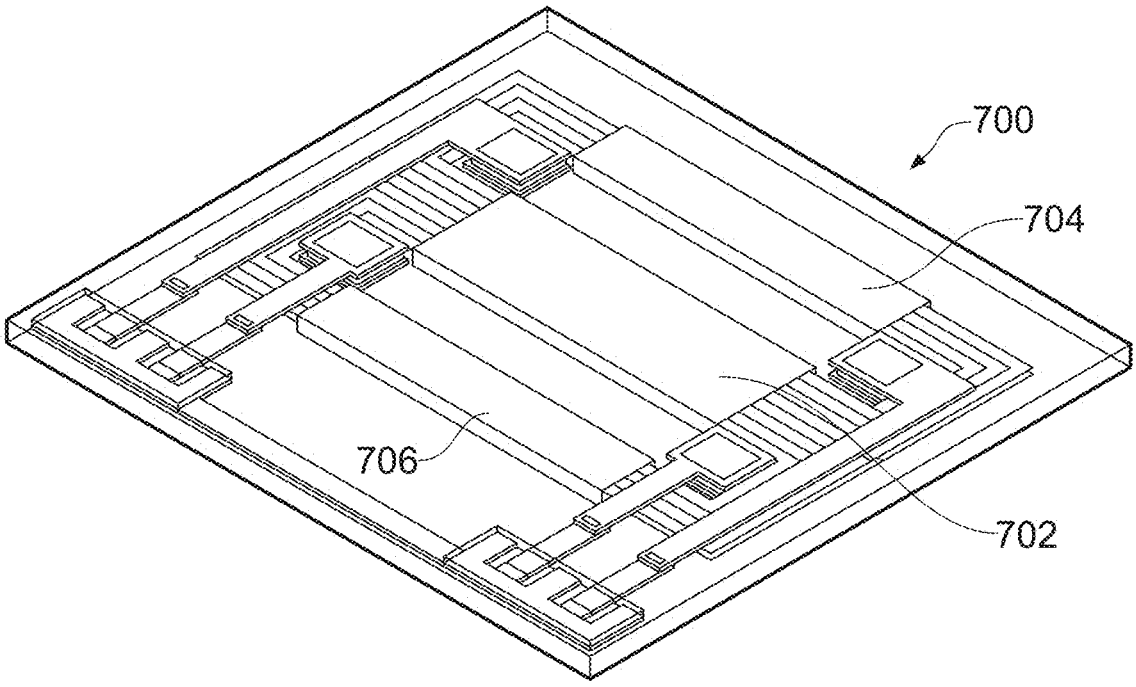
FIG. 14 is a schematic perspective view of a transformer, according to some embodiments.

Although a rectangular two-winding dual-core transformer has been described, other planar transformer designs are possible. For example, additional metallic layers may be provided, or additional coils may be provided in a given layer, in order to increase the number of coils. Also a single tapped winding may be used to form an autotransformer, or a single winding may be used to form an inductor. Furthermore, the windings could be formed in a single layer in a co-wound arrangement. Such an example is shown in FIG. 11. In FIG. 11, a transformer 400 is shown including a primary coil 402 and a secondary coil 404. Coils 402, 404 are co-wound in a single layer of metal. In a further alternative, the windings could be square when viewed from above. This is shown in FIGS. 12 and 13. In FIG. 12, a transformer 500 is shown. The transformer 500 includes four magnetic cores 502, 504, 506 and 508. In FIG. 13, a square transformer 600 is shown. In this example, the cores 602, 604, 606 and 608 extend into the corners, and are trapezoidal in shape. As a further alternative, as shown in FIG. 14, a so-called dual racetrack transformer 700 may be formed. The overlapping portions may be wrapped in a first magnetic core 702, whereas the non-overlapping portions may be wrapped in second and third magnetic cores 704, 706. Any and all of these examples may be combined with the varying turn density shown in FIG. 9.

During fabrication, layers of materials can be patterned and deposited. However, fabrication techniques for making and aligning specific geometries of features are imperfect. As more and more layers are fabricated, connecting features in higher layers to features in lower layers becomes more and more difficult, and resolution becomes limited. Various design technologies can improve the quality factor (Q factor) of inductors and/or transformers despite limited fabrication resolution. For example, one design technology relates to reducing and/or eliminating non-magnetic separations between vias and layers of a magnetic core. Another example design technology relates to controlling the widths of magnetic vias.

FIG. 15A is a cross section though the transformer of FIG. 3 with additional labels relative to FIG. 4. The magnetic core 2 includes an uppermost magnetic layer 801, a bottom magnetic layer 804, and a via 802 coupling the uppermost layer 801 to the bottom layer 804. The uppermost layer 801 couples to the bottom layer 804 at the contact base portion 800. The contact base portion 800 can be referred to as a top and bottom core overlap area. FIGS. 15B, 15C, and 15D are zoomed-in illustrations showing examples of the contact base portion 800 of FIG. 15A in different implementations. It should be noted that although certain examples via features are described with respect to one of the top or bottom layers of the magnetic core, the technology discussed herein can apply to either one or both of the top and bottom layers. Moreover, one or more features of the vias discussed herein can be applied in association with two or more magnetic cores of an inductive component, such as magnetic cores 2 and 3 of FIG. 15A. Other examples of the contact base portion 800 are shown in FIG. 24F and FIG. 25.

A transformer, such as shown in FIG. 15A can be made, for example, by forming the bottom layer 804 of the magnetic core 2, forming an insulation layer, forming a metal layer (e.g., to make winding 50), forming another insulation layer above winding 50, forming metal layer (e.g., to make winding 10), and then forming vias 802 and uppermost layer 801. The uppermost layer 801 and the bottom layer 804 can each include alternating layers of magnetically functional material and insulating material.

In FIG. 15B, the via 802 extends from the uppermost layer 801 of magnetic core 2 and is coupled to the bottom layer 804 of the magnetic core 2. Only an end portion of the bottom layer 804 of the magnetic core 2 is shown in FIG. 15B. The rest of the bottom layer 804 of the magnetic core 2 would extend (not shown) off to the right. The via 802 includes a relatively wide contact base 800 to improve the chances of overlapping contact with the bottom layer 804. The contact base 800 is wider than the rest of the via 802. However, in some other embodiments, the via 802 can have a more generally uniform shape (e.g., the contact base is a similar size and shape to the rest of the via), and the width of the via can refer to the general width of the via. Fabrication tools can define the via 802 with a limited resolution, such as in cases where the via 802 extends across a relatively large topographical height.

The bottom layer 804 can include extension area 805 (bounded by the dotted line) to provide a wider contact target for the via 802. The extra width in both the via 802 and the bottom layer 804 can increase the chances that the via 802 forms a magnetic contact even if a misalignment or feature fabrication deviates from design. For example, although the via 802 is misaligned to the left as shown in FIG. 15B, a sufficient contact can still be formed. If the via 802 were misaligned in an opposite direction (not shown), then the via 802 could still make sufficient contact with the bottom layer 804, and additionally, the similar via on the other side of magnetic core 2 could also still make sufficient contact with the bottom layer.

In FIG. 15C, the via 802 is aligned with the bottom layer 804 of the magnetic core 2 to form a direct contact.

In FIG. 15D, the via 802 is aligned with and coupled to bottom layer 804 by way of a non-magnetic layer 806. The non-magnetic layer 806 can be an insulating material (such as SiO2 or another oxide insulator), separation material, laminate material, or other non-magnetic material. As shown in FIG. 15D, the non-magnetic layer 806 can be disposed between the bottom layer 804 and the via 802. The non-magnetic layer 806 can be about 100 nm thick, for example. As an another example, the non-magnetic separation layer can be about 10 nm thick.

Figure 16:
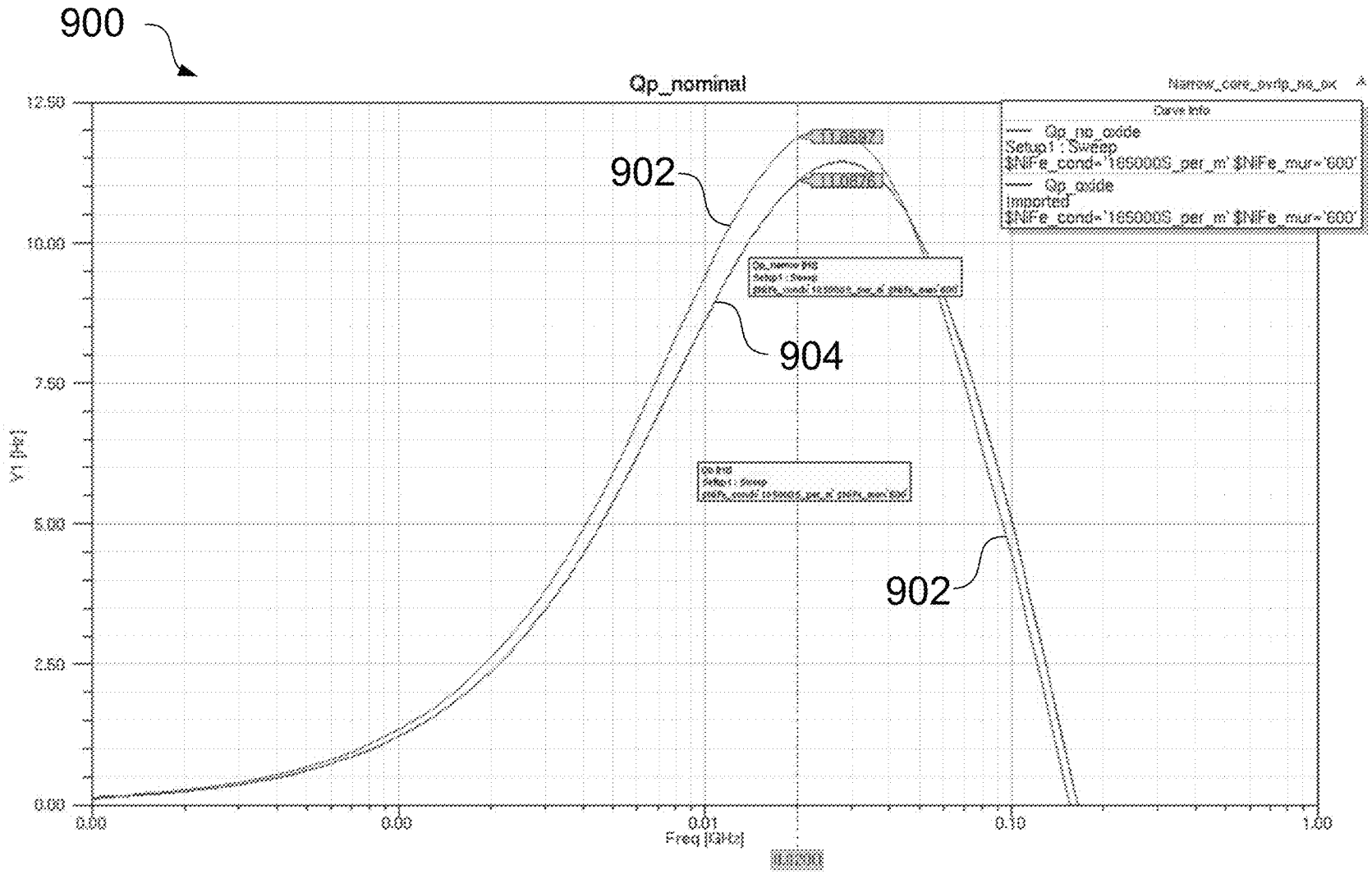
FIG. 16 shows a graph of the quality factor (Q factor) of an inductor in an illustrative transformer across a range of frequencies.

FIG. 16 shows a graph 900 of the Q factor of an inductor in a transformer across a range of frequencies. The x-axis shows a range of frequencies along a log scale in GHz. The y-axis indicates a Q factor. Curve 902 indicates the Q factor of an inductor in a transformer when a via of a magnetic core forms a direct magnetic pathway with a layer of the core (e.g., as shown by FIG. 15C). Curve 904 indicates the Q factor of an inductor in a transformer when a via of a magnetic core is coupled to a layer of the core with a layer of non-magnetic material in between (e.g., as shown by FIG. 15D).

In comparison to a transformer corresponding to FIG. 15D, an inductor in a transformer with a contact base as shown in FIG. 15C has a higher Q factor across lower frequencies below a crossover point somewhere between 0.04-0.05 GHz. At frequencies past the crossover point, the reverse is true. The Q factors peak between 0.02-0.03 GHz in FIG. 16. At the peak, the Q factor indicated by curve 902 is greater than the Q factor indicated by curve 904. At about 0.02 GHz, the Q factor of curve 902 is about 11.8597, and the Q factor of curve 904 is about 11.0876.

Accordingly, the Q factor of an inductor in a transformer can be affected by the construction of the vias in the transformer, including any non-magnetic separation between the top and bottom layers of a magnetic core (e.g., magnetic core 2 as shown in FIG. 15A). Furthermore, the inductance can also be similarly affected by the non-magnetic separation between the top and bottom layers of a magnetic core. In some applications, even a relatively small amount of non-magnetic separation between the top and bottom layers of the magnetic core can affect the inductance and reduced a Q factor. In one example, an inductance dropped from about 470 nH to about 425 nH as a result of an approximately 100 nm of non-magnetic separation between a top and bottom layer of a magnetic core.

In some embodiments, any insulator or other non-magnetic material can be removed before forming a magnetic via to provide a more continuous magnetic pathway. In some embodiments, an uppermost layer of the magnetic core is coupled through a via to the bottom layer of the magnetic core without any intervening non-magnetic materials. In some embodiments, some separation between the via and a layer of the magnetic core may be unavoidable (for example, lamination processes sometimes use a lamination layer). In such embodiments, the separation between the via and the layer of the magnetic core can be reduced or minimized.

Figure 17A:
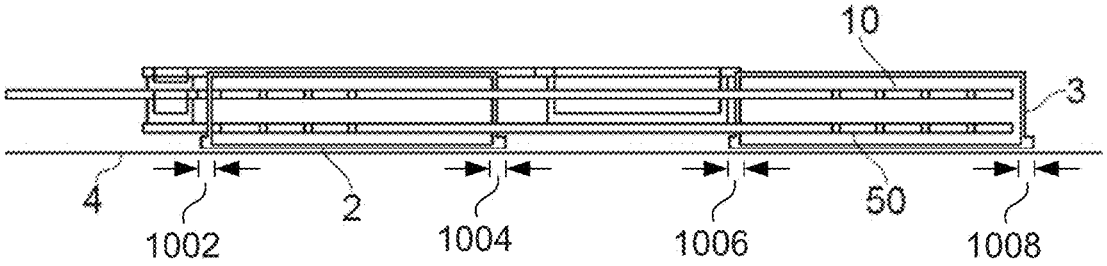
FIGS. 17A and 17B show cross sections of an illustrative transformer with different contact base widths, according to some embodiments.
Figure 17B:
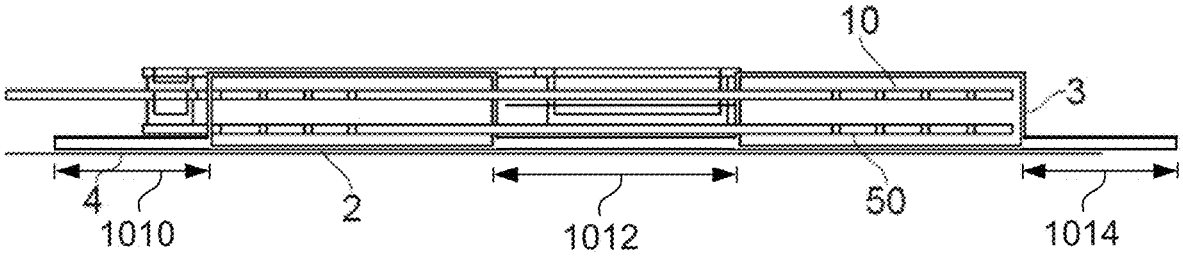

FIGS. 17A and 17B show cross sections of a transformer, according to some embodiments. In FIGS. 17A and 17B, the vias are made of magnetic materials and contact the bottom layer of the magnetic core as shown in FIG. 15C. In FIG. 17A, the vias have widths 1002, 1004, 1006, 1008 that are smaller than the via widths 1010, 1012, 1014 of FIG. 17B. In one example, the contact base widths 1002, 1004, 1006, and 1008 are about 13.5 μm, while the contact base widths 1010, 1012, and 1014 are about 205 μm, 300 μm, and 205 μm, respectively. In FIG. 17B, a portion of the via width 1012 extends from magnetic core 2 to magnetic core 3 such that the extended portion of the contact base is shared by vias on both cores.

Figure 18A:
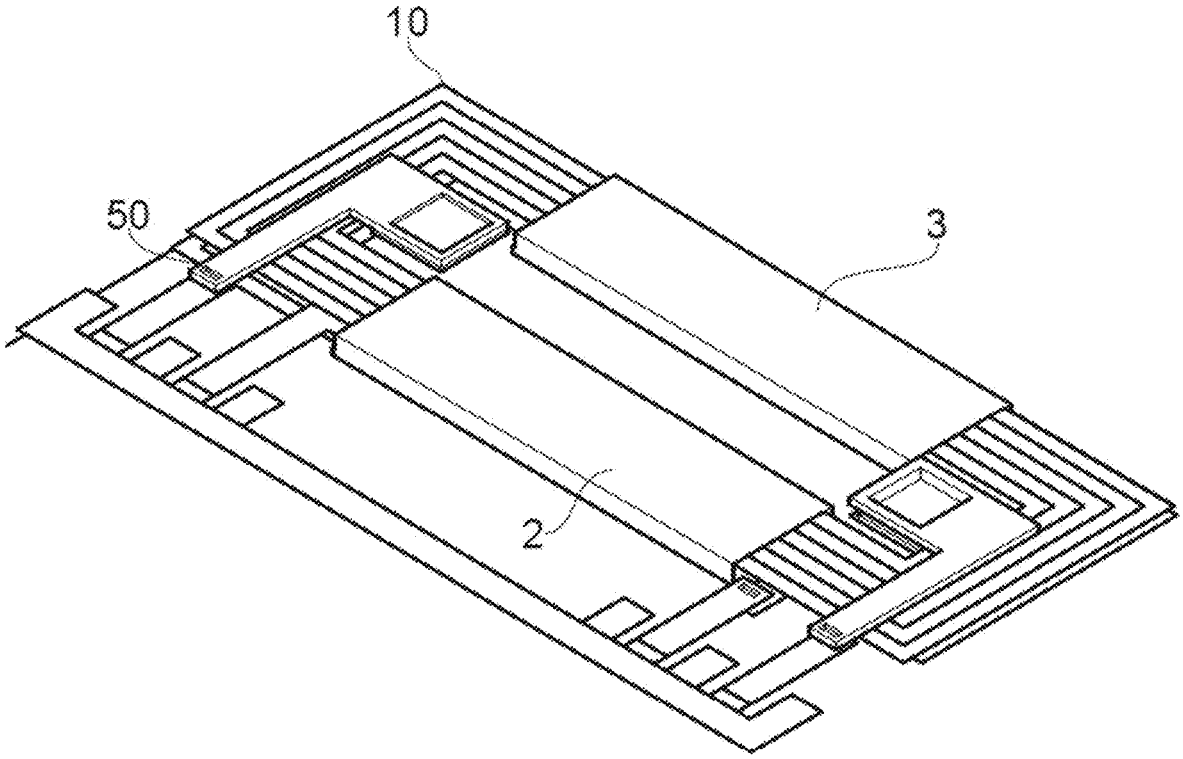
FIGS. 18A and 18B show perspective views of a transformer formed within an integrated circuit with different contact base widths, according to some embodiments.
Figure 18B:
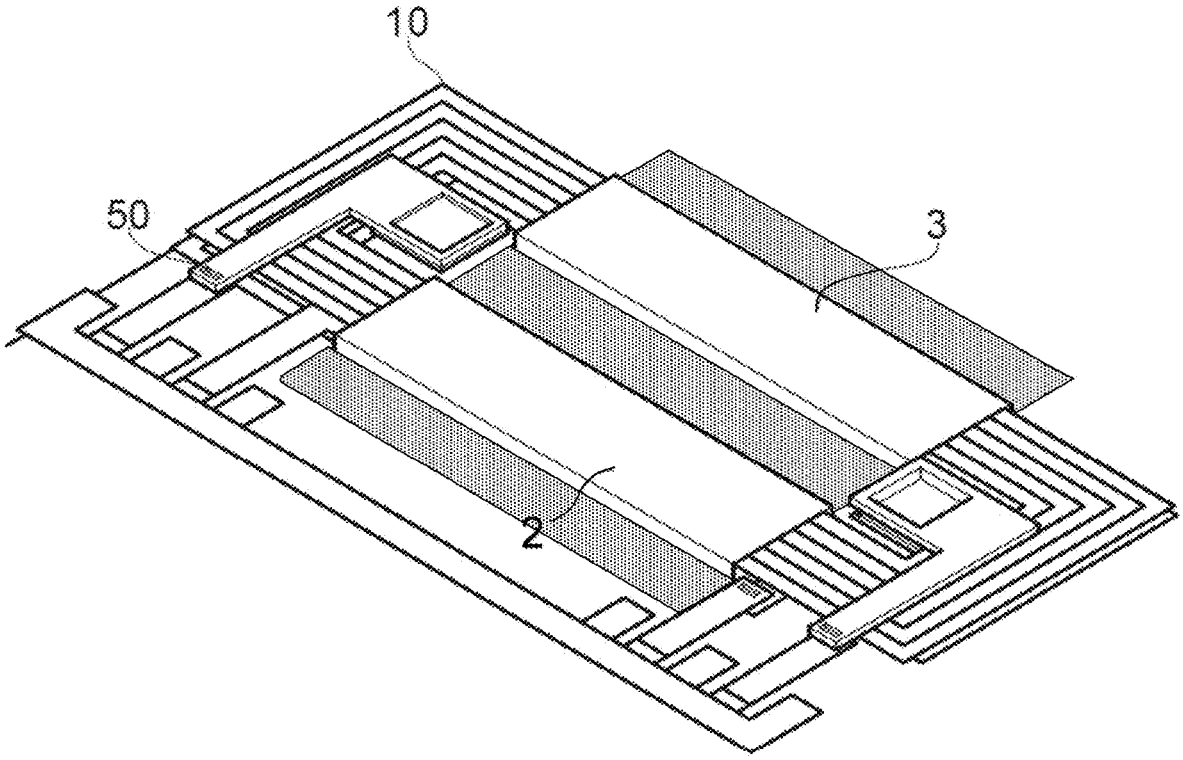

FIGS. 18A and 18B show perspective views of transformers formed within an integrated circuit. The transformers in FIGS. 18A and 18B include elements shown and discussed in relation to the transformer shown in FIG. 3. The transformer shown in FIG. 18A has contact bases that correspond to the contact bases shown in the cross section view in FIG. 17A. The transformer shown in FIG. 18B has contact bases that correspond to the contact bases shown in the cross section view in FIG. 17B. In FIG. 18B, the shaded portions show the extended contact bases that are present in FIG. 18B but not present in FIG. 18A.

Figure 19:
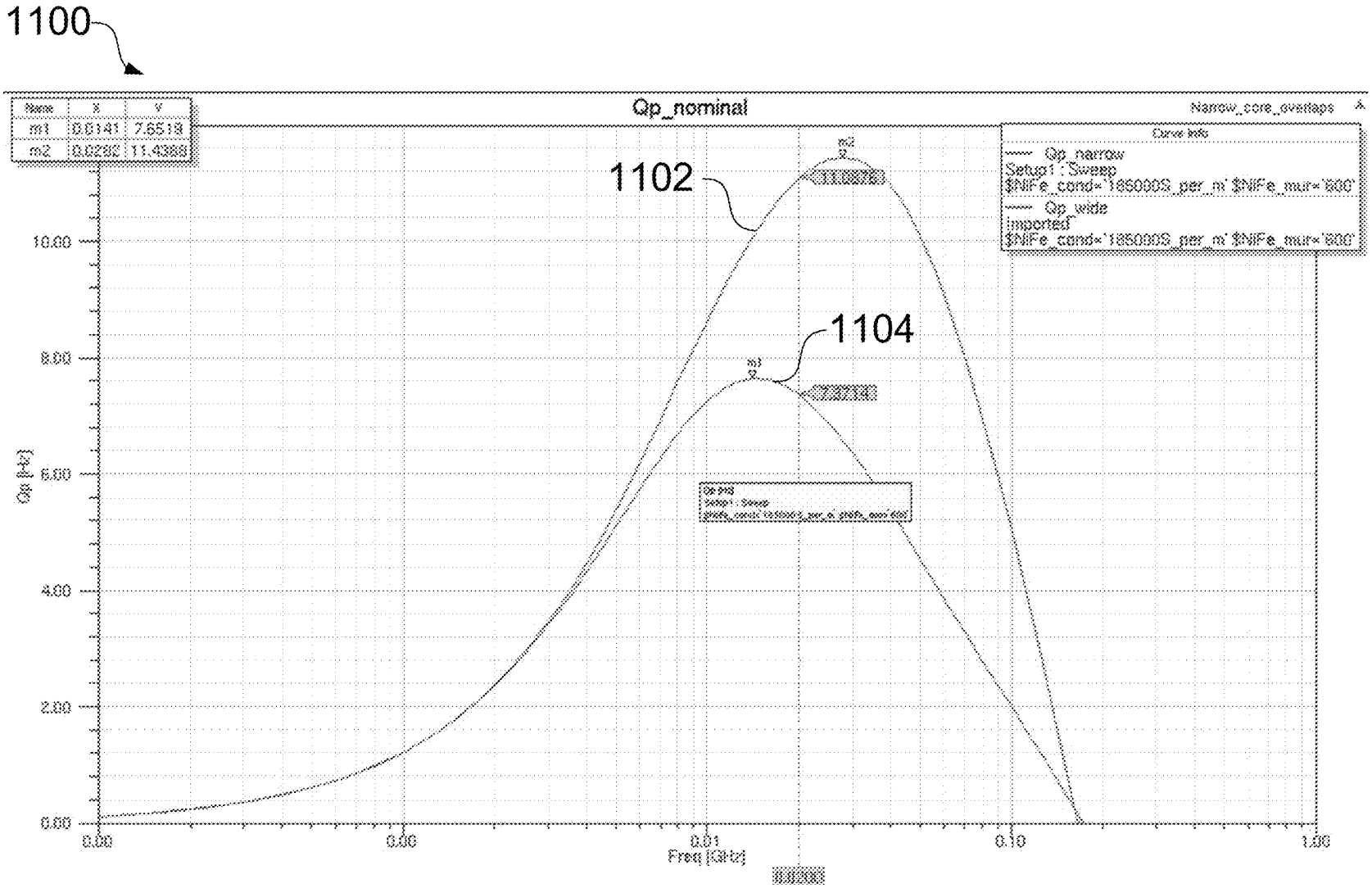
FIG. 19 shows a graph of the Q factor of an inductor in a transformer across a range of frequencies.

FIG. 19 shows a graph 1100 of the Q factor of an inductor in a transformer across a range of frequencies. The x-axis shows a range of frequencies along a log scale in GHz. The y-axis indicates a Q-factor. Curve 1102 indicates the Q factor of an inductor in a transformer with narrower via widths (e.g., as shown by FIG. 17A). Curve 1104 indicates the Q factor of an inductor in a transformer with wider contact base widths (e.g., as shown by FIG. 17B).

As shown in FIG. 19, the inductor in the system of FIG. 17A has a higher Q factor across a substantial range of frequencies. For example, at about 0.02 GHz, the Q factor of curve 1102 is about 11.8576, and the Q factor of curve 1104 is about 7.3714.

The difference in Q factor can be significant. With a greater Q factor, an inductor coil can store more energy in comparison to the amount of energy that is dissipated. The Q factor is typically inversely proportional to the amount of energy lost. For example, for a frequency of about 0.02 GHz, the system shown in FIG. 17A would lose about 1/11.1, or about 9.01% of energy while the system shown in FIG. 17B would lose about 1/7.37, or about 13.5% of energy. Accordingly, the transformer of FIG. 17B can have about 1.5 times the energy losses of the transformer of FIG. 17A.

Accordingly, the Q factor of an inductor in a transformer can be affected by the construction of the vias in the transformer, including the via width.

Figure 20A:
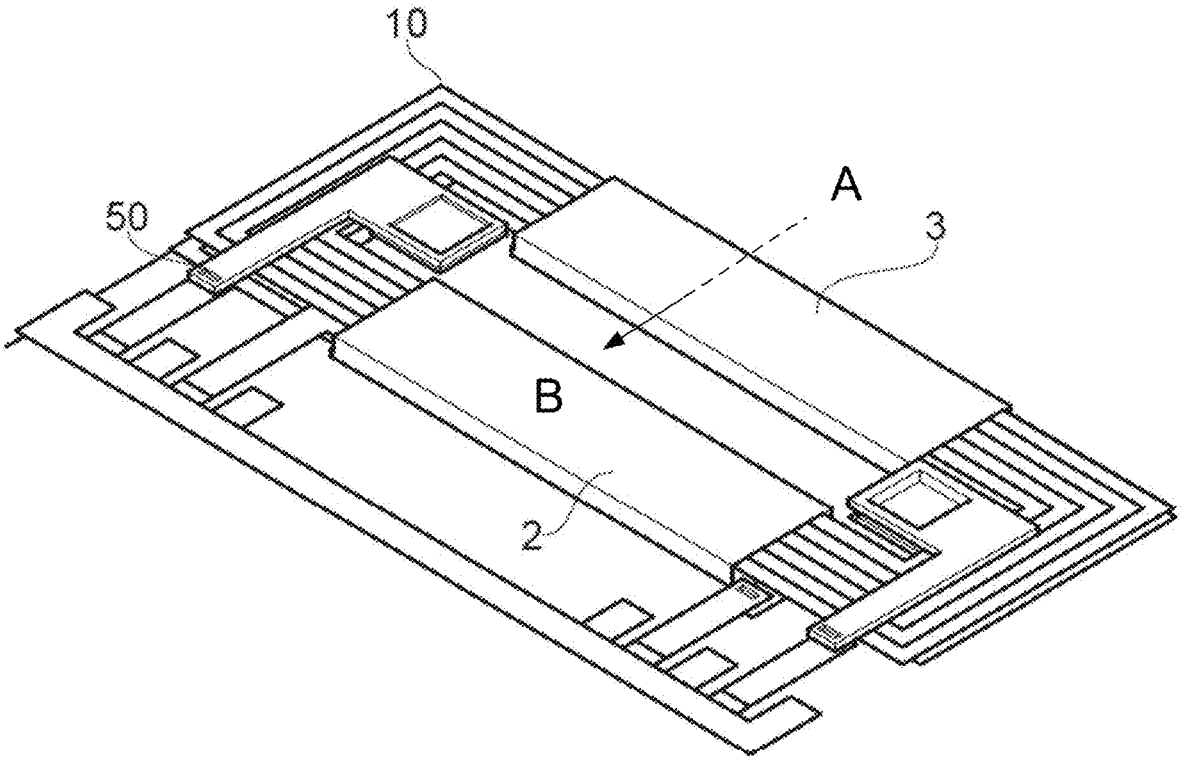
FIG. 20A shows a perspective view of a transformer formed within an integrated circuit, according to some embodiments.
Figure 20B:
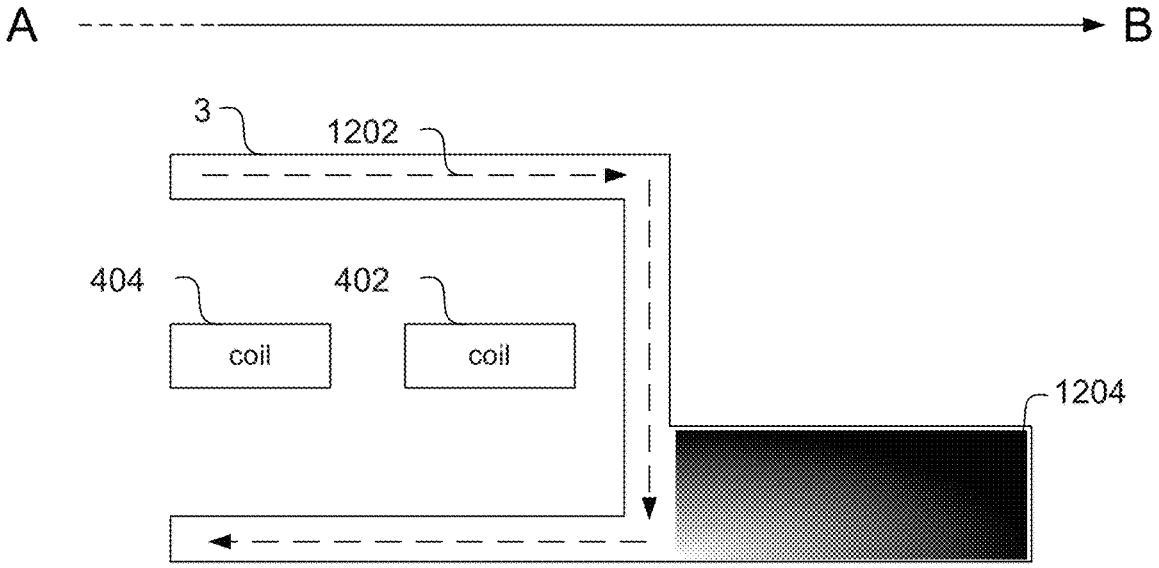
FIG. 20B shows a cross section view of the transformer in FIG. 20A.

FIG. 20A shows a perspective view of a transformer formed within an integrated circuit. The transformer in 20A incorporates elements of the transformer shown in FIG. 18A and includes a line from A to B defining a cross-section illustrated in FIG. 20B. FIG. 20B shows a cross sectional view of the transformer in FIG. 20A taken along the solid part of the line from A to B shown in FIG. 20A. FIG. 20B illustrates the magnetic core 3 and windings co-wound in a single layer of metal (e.g., as described with respect to FIG. 11). In FIG. 20B, the dotted lines 1202 indicate a direction of magnetic flux flow.

A magnetic lamination in the plane of the magnetic flux (e.g., in the plane of the dotted lines 1202) helps to reduce eddy current circulation. However, magnetic laminations perpendicular to the plane of magnetic flux flow (e.g., the more darkly shaded via area around 1204) typically does not efficiently reduce eddy current circulation. Accordingly, a magnetic material thickness (e.g., thicknesses of the top and bottom layers of the magnetic core) and a magnetic material width (e.g., a width of the via including a width of the base of the via) can be large enough to keep the magnetic flux flowing. At the same time, the width of the via can be minimized or reduced to improve the Q factor.

Accordingly, in some embodiments, the width of the via can be about equal to the thickness of the top layer and/or the bottom layer of magnetic core. In some embodiments, the via can be at least half the thickness of the top layer and/or the bottom layer of magnetic core. In some embodiments, the width of the via can be less than 150%, 200%, or 500% of the thickness of the top layer and/or the bottom layer of magnetic core. In some embodiments, an uppermost layer of the magnetic core is formed after the bottom layer of the magnetic core and after metals and/or isolation layers are formed above the bottom layer of the magnetic core, and the width of the via can be about a minimum via feature width that reliably establishes contact between the top and bottom layers of the magnetic core with commercially acceptable yields. In some embodiments, the width of the via is large enough so that a magnetic reluctance of a separation layer is larger than the magnetic reluctance of the via and so that the magnetic flux travels predominantly through the via instead of around the via.

FIG. 21A shows a cross section of a transformer including elements shown and discussed in relation to the transformer of FIG. 17B. FIG. 21A includes a contact base portion 1500 with details shown in FIG. 21B. The contact base portion 1500 of FIG. 21B includes more features than the contract base portion shown in FIG. 17B.

As shown in FIG. 21B, the magnetic core 3 includes a lowermost magnetic layer 1502. Above the lowermost magnetic layer 1502 is an insulating or separation layer 1504. The separation layer 1504 includes a separation material 1516 such as an oxide such as $SiO_2$, a nitride, such as $Si_3N_4$, or any other suitable separation layer. The magnetic core also includes a magnetic layer 1506. A via through the separation layer 1504 couples the lowermost magnetic layer 1502 to the magnetic layer 1506. The via shown in FIG. 21A is illustrated with sloped sidewalls. Some other embodiments can include vertical vias. In some embodiments, a via width 1524 can be a few micrometers, such as about 2-4 μm. In some embodiments, the via width 1524 can be comparable to a thickness of a layer of the magnetic core (e.g., lowermost magnetic layer 1502 or magnetic layer 1506). The via width 1524 can be less than about 5 times the thickness of the layer of the magnetic core and still provide relatively low loss performance.

The lowermost magnetic layer 1502 can include layers 1508 and 1510 of magnetic material. The magnetic material can be, for example, CoZrTa. A layer of magnetic material such as 1508 and/or 1510 can be about 100 nm thick in some embodiments. The lowermost magnetic layer 1502 can also include a lamination layer 1518. A lamination material can include, for example, Al2O3 or aluminum nitride. In some embodiments, the lamination layer 1518 is about 10 nm thick or less. In some embodiments, lamination layers such as 1518, 1520, and/or 1522 can be a minimum thickness for an available lamination process, such as about 10 nm, about 20 nm or less, etc. In some embodiments, along the via width 1524, the lamination layers have a smaller thickness. Some embodiments can feature more or fewer lamination layers.

The magnetic layer 1506 can include layers of magnetic materials 1512 and 1514. The magnetic layer 1506 can also include lamination layers 1520 and 1522. Some embodiments can include more or fewer lamination layers and/or more or fewer layers of magnetic material. The lamination layers 1520 and 1522 can include insulating material and in such cases be referred to as insulating layers.

The separation layer 1504 separates parts of the lowermost magnetic layer 1502 from the magnetic layer 1506. By separating the magnetic layer 1506 from the lowermost magnetic layer 1502, eddy currents can be reduced along the magnetic layers 1506 and 1502. At the same time, a magnetic via through the separation layer 1504 still allows magnetic flux to travel through.

Figure 22A:
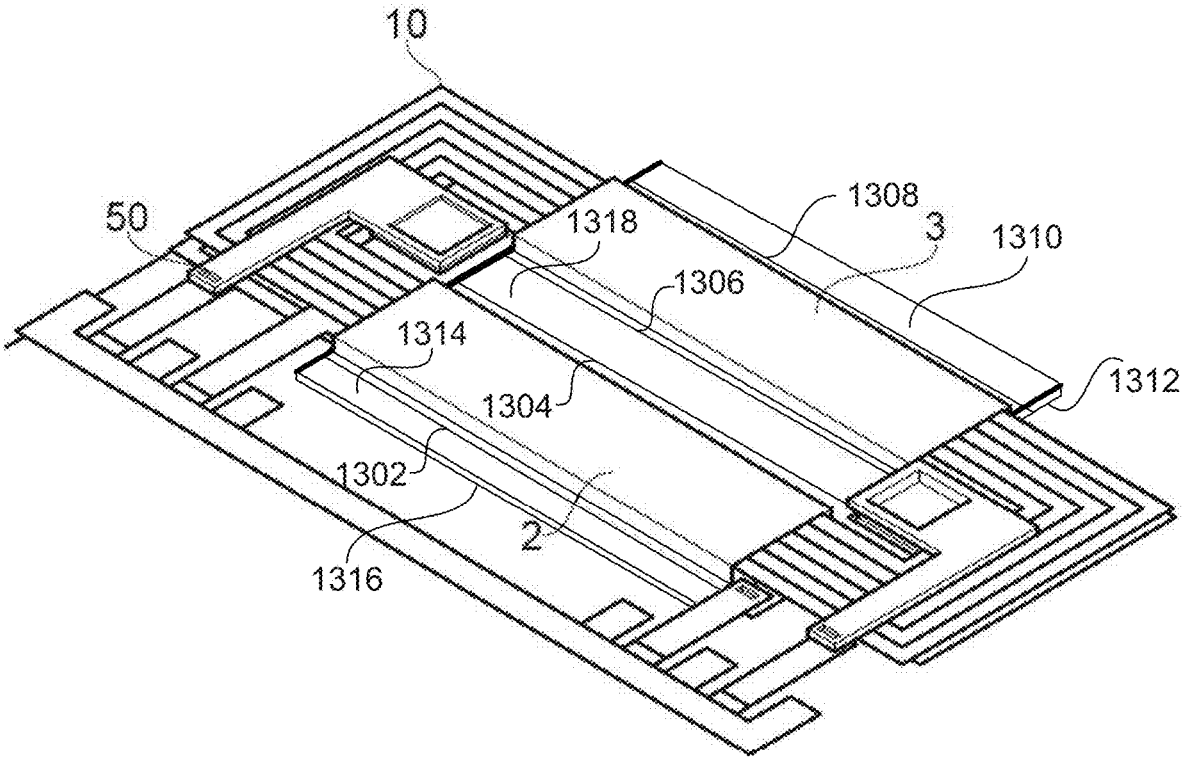
FIG. 22A shows a perspective view of a transformer formed within an integrated circuit including the contact bases shown in FIG. 21B, according to some embodiments.
Figure 22B:
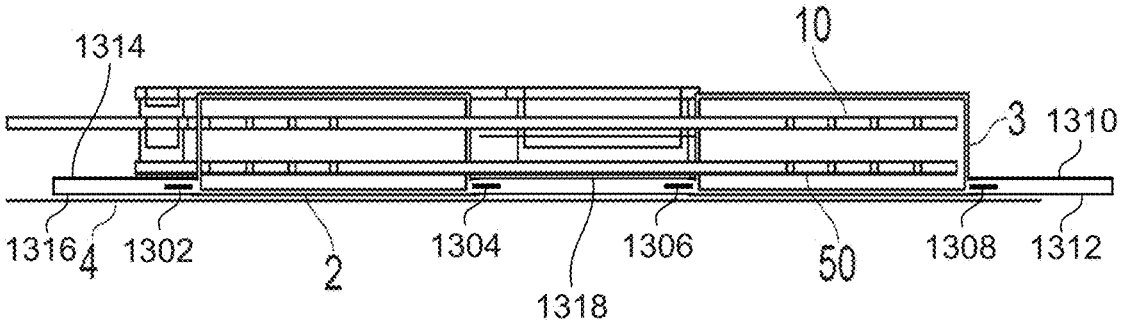
FIG. 22B shows a cross section view through FIG. 22A.

FIG. 22A shows a perspective view of a transformer formed within an integrated circuit including the contact base as shown in FIG. 21B. FIG. 22B shows a cross section view through FIG. 22A. In comparing FIG. 22A to FIG. 18B, the wide magnetic contact bases (black areas) in FIG. 18B of the design shown in FIG. 15C have been replaced in FIG. 22A with the more complex design shown in FIG. 21B. In FIG. 22A and FIG. 22B, the magnetic vias 1302, 1304, 1306, and 1308 correspond to vias that pass through a separation layer 1504 in FIG. 21B. In FIG. 22A, the magnetic layers 1314, 1318, and 1310 correspond to the magnetic layer 1506 shown in FIG. 21B. In FIG. 22A, the lower magnetic layers 1312 and 1316 correspond to the lower magnetic layer 1502 shown in FIG. 21B.

In FIG. 22A, a layer of magnetic material 1310 extends out above via 1308. The lower layer of magnetic material 1312 extends below via 1308. Via 1308 is coupled between the layer of magnetic material 1310 and the lower magnetic layer 1312. In some embodiments, there can be insulators, separation layers, and/or lamination layers between the layer of magnetic material 1310 and the lower magnetic layer 1312.

The layer of magnetic material 1314 extends out above via 1302. The lower layer of magnetic material 1316 extends out below via 1302. Via 1302 is coupled between the layer of magnetic material 1314 and lower layer of magnetic material 1316. In some embodiments, there can be insulators, separation layers, and/or lamination layers between the top portion of magnetic material 1314 and the bottom portion of magnetic material 1316.

Between magnetic cores 2 and 3, layer of magnetic material 1318 extends above vias 1304 and 1306 in FIG. 22A. A lower layer (not visible) of magnetic material between magnetic cores 2 and 3 extends below vias 1304 and 1306. In some embodiments, there can be insulators, separation layers, and/or lamination layers between the magnetic layer 1318 and lower layers of magnetic material. Although the magnetic material between magnetic cores 2 and 3 is illustrated as one continuous portion in FIGS. 21A and 21B, in some embodiments, the magnetic material between magnetic cores 2 and 3 can have one or more gaps or separations (not illustrated). In the example embodiment, the vias 1302, 1304, 1306, and 1308 form lines, but the vias 1302, 1304, 1306, and 1308 can be arranged differently in some other embodiments.

Figure 23A:
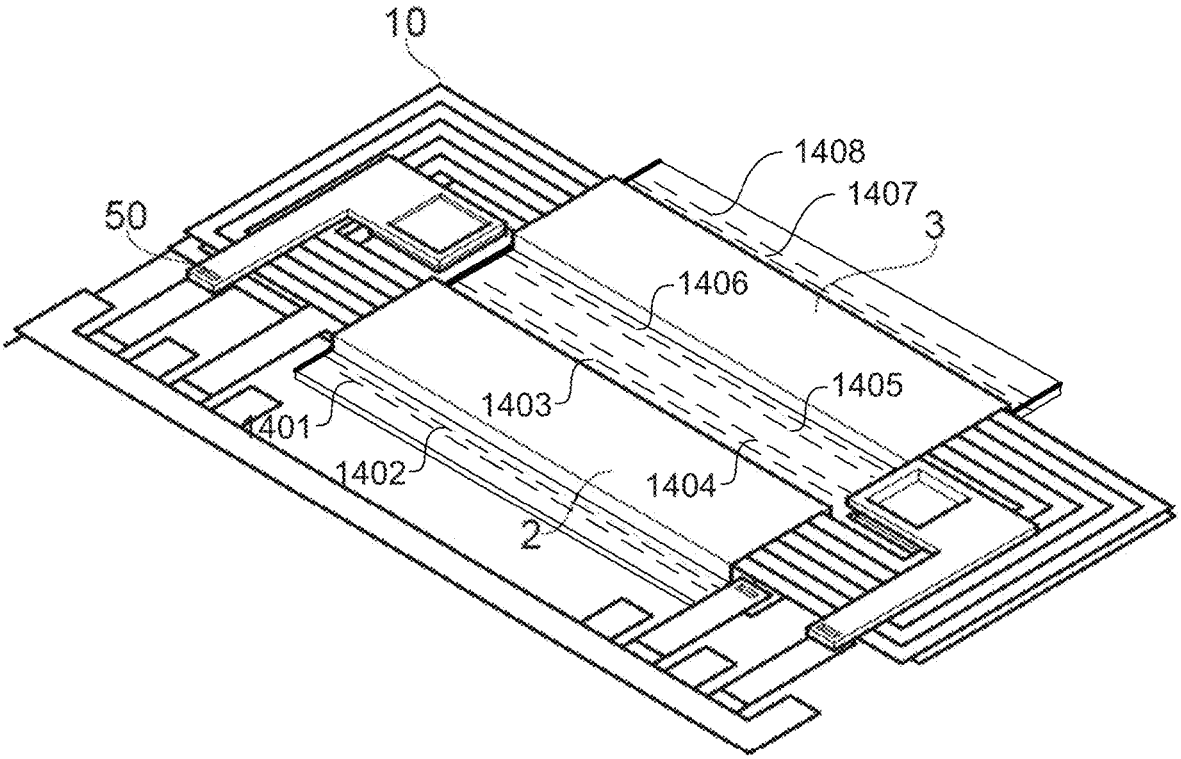
FIG. 23A shows a perspective view of a transformer formed within an integrated circuit, according to some embodiments.
Figure 23B:
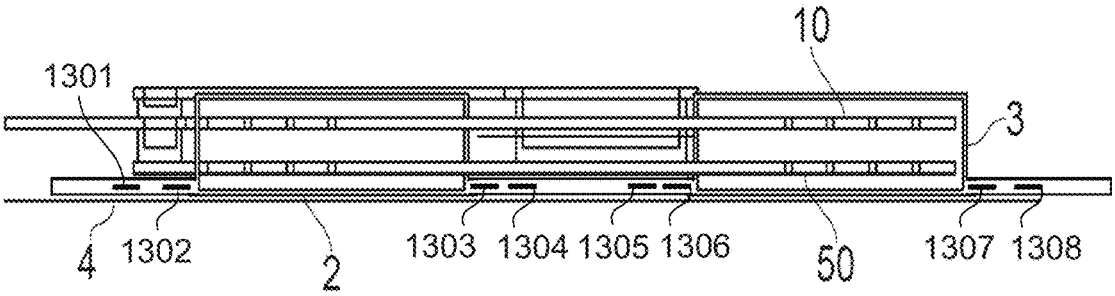
FIG. 23B shows a cross sectional view through the transformer of FIG. 23A.

FIG. 23A shows a perspective view of a transformer formed within an integrated circuit that includes elements shown and discussed in relation to the transformer of FIG. 22A. FIG. 23B shows a cross section view through FIG. 23A. The continuous line vias 1302, 1304, 1306, 1308 shown in FIG. 22A are replaced in FIG. 23A with lines of shorter, individual vias 1402, 1404, 1406, 1408. Also, additional lines of individual vias 1401, 1403, 1405, 1407 have been added. Dividing the lines into relatively short, individual vias can reduce eddy current circulation. The additional lines of vias can also be beneficial if via widths can be fabricated narrowly. The additional lines of vias can be added so that the vias do not saturate with magnetic flux as quickly. In some embodiments, using multiple rows of vias can improve magnetic reluctance. In some embodiments, the rows of vias can be offset and/or overlap, at least partially. For example, vias in the line of individual vias 1401 are offset from and partially overlap with vias in the line of individual vias 1402. Accordingly, magnetic flux that does not go through a via in the line 1401 can still go through a via in line 1402.

FIGS. 24A-24F show example schematic cross sections of a contact base portion (which may, for example, include elements of the contact base 1500 in FIG. 21A) during fabrication of a low-loss magnetic via, according to some embodiments. The technology discussed with respect to FIGS. 24A-24F can be used in making contact bases in accordance with any suitable principles and advantages discussed herein.

Figure 24A:
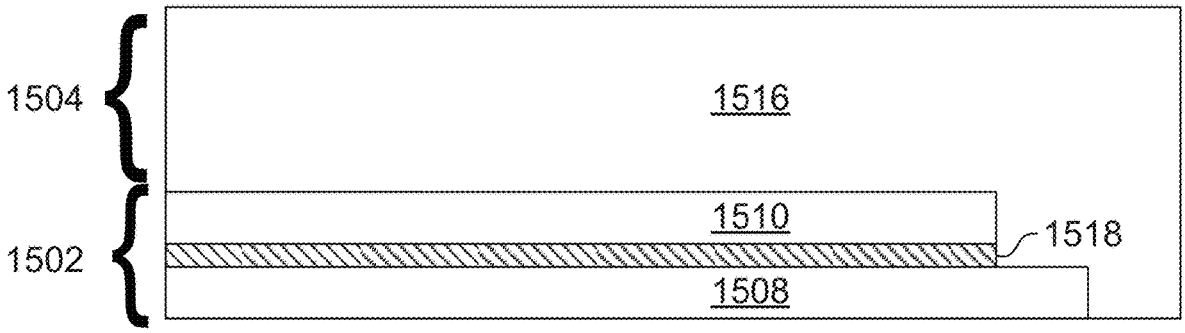
FIGS. 24A-24F show example schematic cross sections of a contact base during different stages of fabrication of a magnetic via, according to some embodiments.

As shown in FIG. 24A, a lower magnetic layer 1502 of the magnetic core can be deposited and patterned. This can include depositing the magnetic materials such as 1508 and 1510, metals (not shown), and lamination layers such as 1518. A separation layer 1504 including separation material 1516 can also be deposited.

Figure 24B:
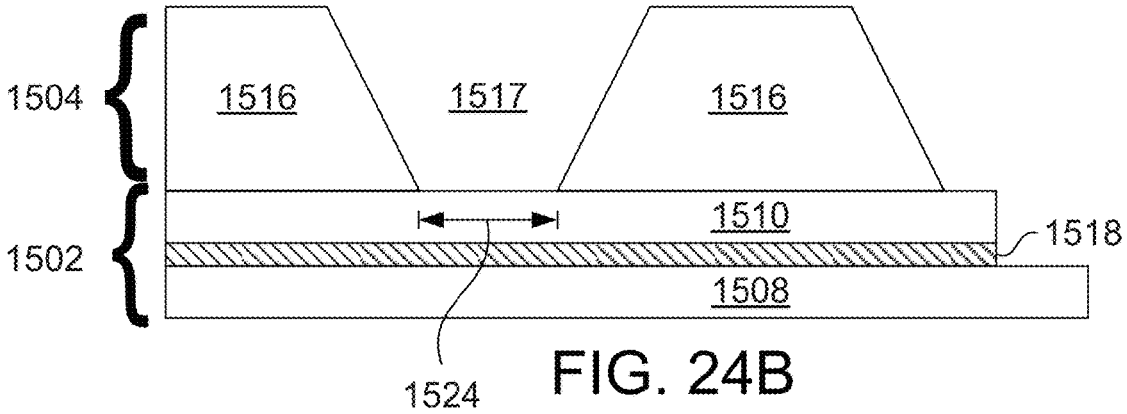

As shown in FIG. 24B, the separation layer 1504 can be patterned. The pattern can include forming one or more openings 1517 for vias through the separation layer 1504. The separation layer 1504 can be patterned to include sloped sidewalls along the separation materials 1516. The width of the separation layer 1504 can be used to affect the width of the lower magnetic layer 1502 of the magnetic core. A wider separation layer 1504 will leave a wider lower magnetic layer 1502 of the magnetic core after etching.

The opening 1517 is made in a separation layer 1504 that is at a relatively lower topography level above a wafer surface and/or above the lower magnetic layer 1502 of the magnetic core. At the relatively lower topography level, relatively higher-resolution lithography tools can create relatively smaller geometries with more precise alignment. Accordingly, a via formed in opening 1517 can be relatively well aligned and have a relatively finely controlled width 1524.

In comparison, as shown in FIG. 10, the magnetic material along the sides of the V-shaped depression 320 couples the uppermost magnetic layer 322 through the insulating layers 318, 310, and 302 to the lowermost magnetic layer 300. The magnetic material in FIG. 10 is made in the V-shaped depression 320 at relatively higher levels above a wafer surface (e.g., the surface of substrate 4) and or the lower magnetic layer 300 of the magnetic core 2. At the relatively higher levels, relatively lower-resolution lithography tools can create relatively larger geometries with less precise alignment. Accordingly, the magnetic material along the sides of the V-shaped depression 320 shown in FIG. 10 can be more coarsely aligned than the via formed in opening 1517 of FIG. 24B, and the width of the magnetic material along the sides of the V-shaped depression 320 shown in FIG. 10 can be less finely controlled width than the width 1524 of a via formed in the opening shown in FIG. 21B.

Figure 24C:
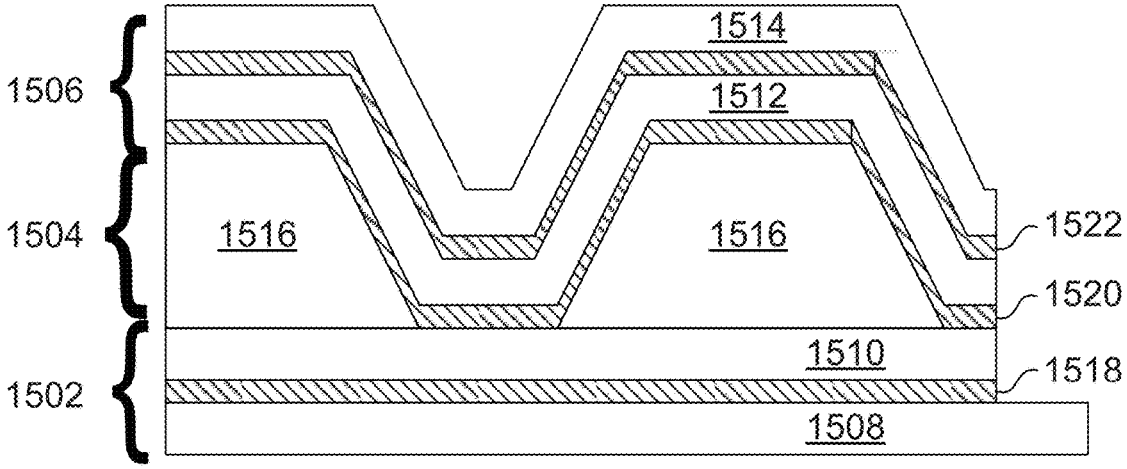

As shown in FIG. 24C, the magnetic layer 1506 of the magnetic core can be deposited. This can include depositing the magnetic materials such as 1512 and 1514, metals (not shown), and lamination layers such as 1520 and 1522. In some embodiments, the magnetic layer 1506 can include more or fewer layers of magnetic and lamination layers. For example, in some embodiments, the magnetic layer 1506 has 25 or more periods of alternating magnetic and lamination layers for about 2 μm thickness.

Figure 24D:
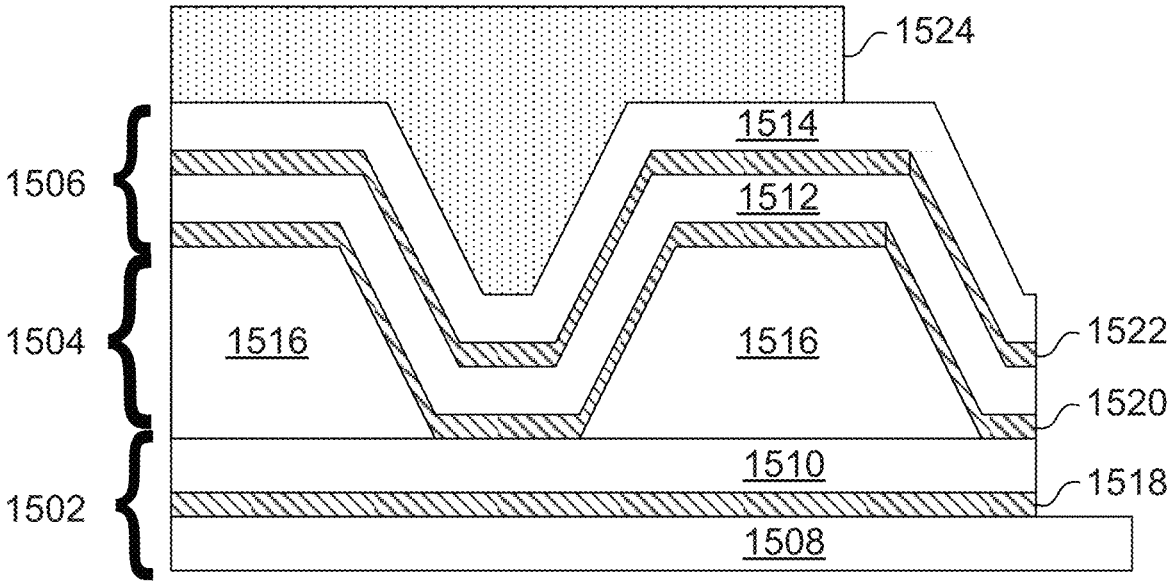

In FIG. 24D, a mask resist 1524 is deposited and/or patterned. The width of the mask resist 1524 can be used to affect the width of the magnetic layer 1506 of the magnetic core. A wider mask resist 1524 will leave a wider magnetic layer 1506 of the magnetic core after etching.

Figure 24E:
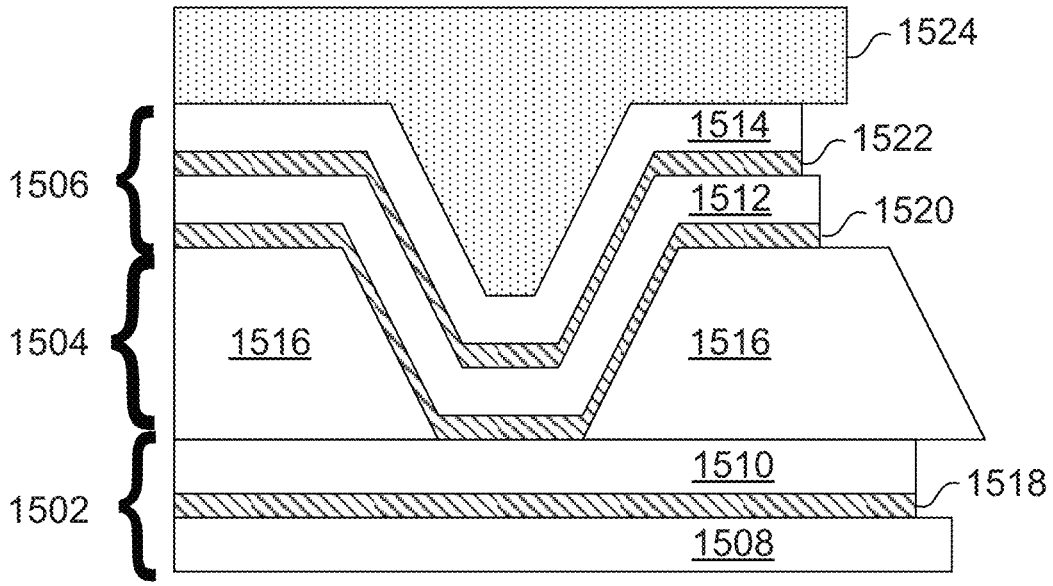
Figure 24F:
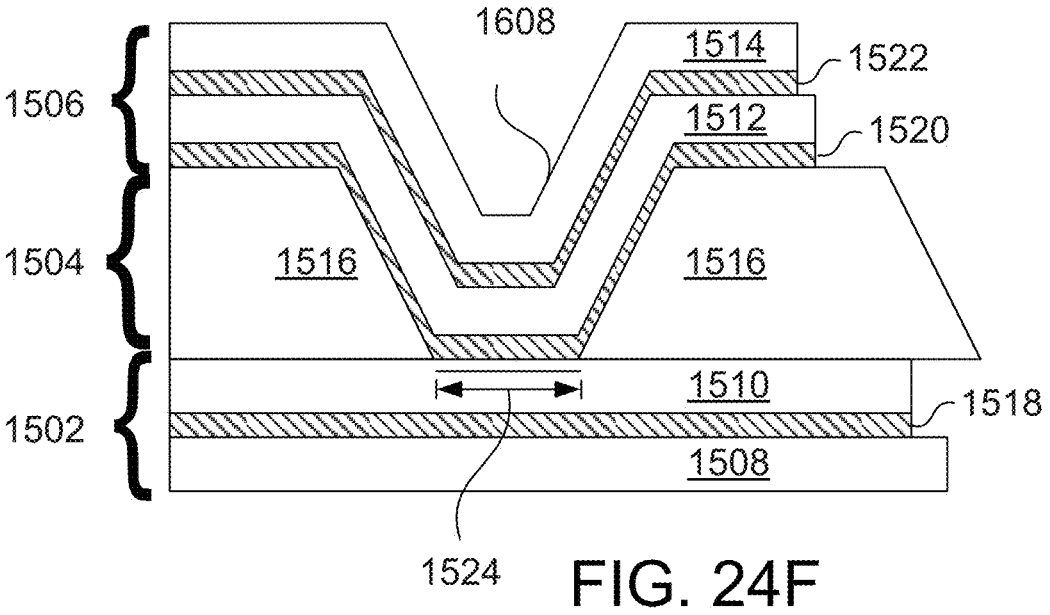

As shown in FIG. 24E, the magnetic layer 1506 and the lower magnetic layer 1502 of the magnetic core can be etched from the side. In some embodiments, etching the magnetic layers 1506 and 1502 of the magnetic core can be done at the same time, using the same resist. During etching, the separation layer 1504 serves to mask the lower magnetic layer 1502 of the magnetic core. Etching for longer periods of time will reduce the overall width of the magnetic layers 1502 and 1506.

As shown in FIG. 24F, the photoresist 1524 can be dissolved or otherwise removed.

Figure 25:
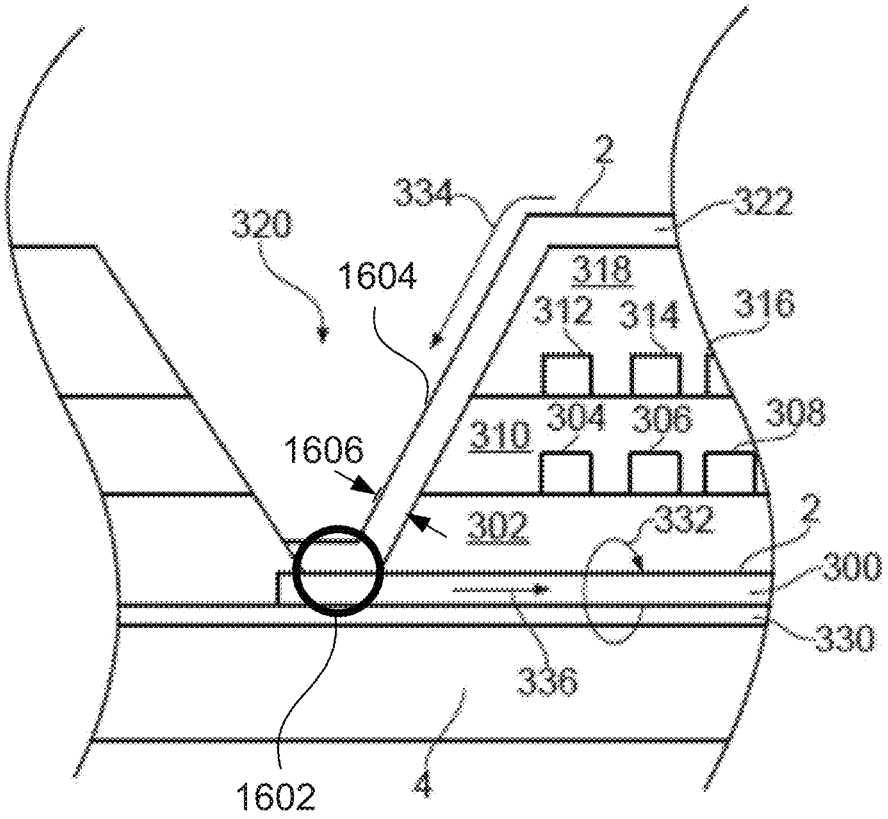
FIG. 25 is a schematic cross section through an illustrative integrated circuit device containing a low-loss magnetic via, according to some embodiments.

FIG. 25 is a schematic cross section through a device in accordance with an embodiment of this disclosure. FIG. 25 includes a contact base 1602, which includes the example structure shown in FIG. 24F.

Accordingly, with respect to both FIGS. 24F and 25, an example design is shown for a magnetic core 2 that can improve the quality factor of an inductive component (e.g., one or more inductors formed by windings 304, 306, 308, 312, 314, 316). The magnetic core 2 includes the uppermost magnetic layer 322 and a lowermost magnetic layer 300. The lowermost magnetic layer 300 is deposited on a substrate 4, such as a semiconductor substrate. The uppermost layer 322 of FIG. 25 corresponds to the magnetic layer 1506 of FIG. 24F and the lowermost magnetic layer 300 of FIG. 25 corresponds to the magnetic layer 1502 of FIG. 24F. In some embodiments, the uppermost magnetic layer 322 and the magnetic layer 1506 can be the same layer of magnetic material or same multilayer structure including magnetic and lamination materials.

The uppermost layer 322 makes up part of the top layer of core 2, and the top layer of core 2 also includes a sloped portion 1604 that includes magnetic material. In the sloped portion 1604, the magnetic laminations can be in the correct orientation with respect to magnetic flux travel. The sloped portion 1604 continues to the contact base portion 1602.

In the contact base portion 1602, the magnetic material becomes horizontal and is separated from the lowermost magnetic layer 1502 (corresponding to the layer 300 of FIG. 25) by a separation layer 1504. A portion of magnetic material forms a via 1608 through the separation layer 1504, coupling the magnetic layer 1506 to the lowermost magnetic layer 1502. The width 1524 of the via 1608 is smaller than the width of the contact base. Some of the magnetic material in the magnetic layer 1506 remains separated from the bottom magnetic layer 1502 by the separation layer 1504. In some embodiments, the via 1608 can have a width 1524 that is about a thickness of the lowermost magnetic layer 1502, magnetic layer 1506, and/or uppermost magnetic layer 322. In some embodiments, the via 1608 can have a width 1524 that is between 25% to 200%, 300%, or 500% of the thickness of any of: the lowermost magnetic layer 1502, magnetic layer 1506, and/or uppermost magnetic layer 322. In some embodiments, the via 1608 can have sloped sides. In some embodiments, the width 1524 of the via 1608 is at least 2 times, 5 times or 10 times narrower than a width 1606 of the opening 320 of FIG. 25. In some example embodiments, the width 1524 is about 2 to 4 μm and the width 1606 is about 20 to 40 μm.

The via 1608 forms a pathway for magnetic flux to flow between the uppermost magnetic layer 322 to the lowermost magnetic layer 300. In some embodiments, a lamination layer 1520 is at the interface between the via 1608 and the lowermost magnetic layer 1502. The layers of magnetic material 1512 and 1514 in the magnetic layer 1506 can be on lamination layers 1520 and 1522 as illustrated. In some embodiments, the lamination layers 1520 and 1522 can be avoided. In some embodiments, a thickness of the lamination layers 1520 and 1522 can be made relatively thin, such as less than 20 nm, less than 10 nm, as thin as the lamination process will allow, etc., especially where the via 1608 interfaces with the lowermost magnetic layer 1502. Although three lamination layers are shown in FIG. 24F, it should be understood that different fabrication and/or lamination processes can use any suitable number of lamination layers. Furthermore, although one via 1608 is shown in FIG. 24F, it should be understood that some embodiments can include a plurality of vias 1608, which can be arranged in one or more rows, for example, as shown in FIG. 23A. In some embodiments, the separation material 1516 in FIG. 24F can be the same material as the insulation material 302 in FIG. 25. In some embodiments, the separation material 1516 can be a same or thinner layer as the insulation material 302. In some embodiments, the separation material 1516 can be a different material and/or in a different layer from insulation material 302.

Figure 26:
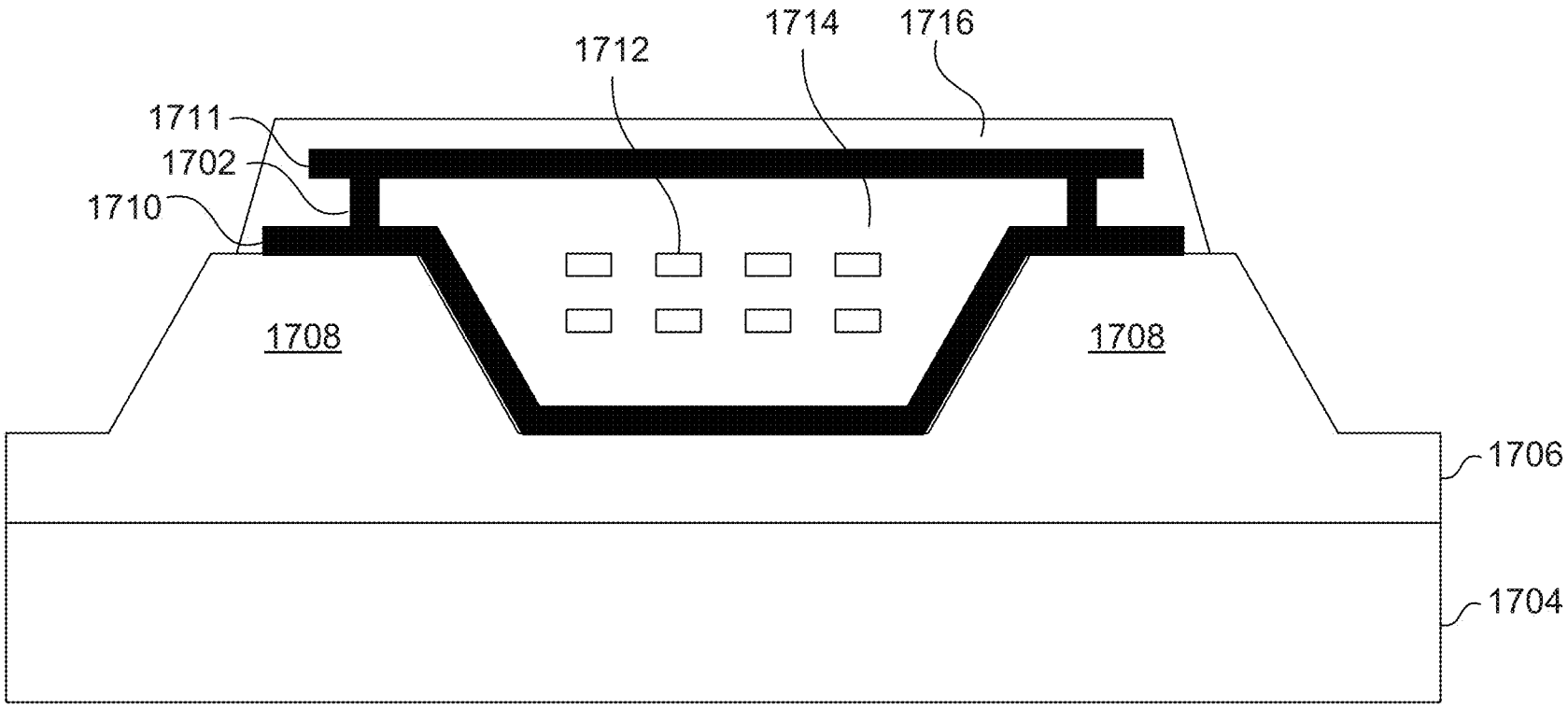
FIG. 26 is a schematic cross section through a device, according to some embodiments.

FIG. 26 is a schematic cross section through a device in accordance with an embodiment of this disclosure. FIG. 26 includes a wafer or substrate layer 1704, a layer 1706 that can be an oxide or a continuation of the wafer 1704 that has been etched into, a plurality of windings 1712, insulator material 1714, and insulator material 1716. As illustrated, the layer 1706 includes steps 1708 forming a trench therebetween. A via 1702 is between a bottom magnetic layer 1710 of a magnetic core and an upper magnetic layer 1711 of a magnetic core.

In some embodiments, the layer 1706 is an oxide layer that is deposited onto the substrate layer 1704. In some embodiments, the layer 1706 is part of the substrate, and steps 1708 are formed by etching parts of the substrate away. The bottom magnetic layer 1710 of the magnetic core can be deposited on the layer 1706. The bottom magnetic layer 1710 can be deposited across the trench such that sloped portions of magnetic material form along the sidewalls and across the tops of the steps 1708.

The uppermost layer 1711 of the magnetic core can be defined using a later lithography step in one plane. In some embodiments, a fabrication step height can be reduced when the windings 1712 are placed between the steps 1708. The via 1702 passes through a portion of the insulator material 1714. The height of the via 1702 can be shorter in topographical height as compared to via 802 in FIG. 15A. In some applications, the step height can be about 10, 25, 50, or 75 micrometers. The height can be selected such that masks for some portions of the integrated circuit can be dispensed on a smooth, flat surface. Because the via ending at the portion of the bottom magnetic layer 1710 at the top of step 1708 is relatively shorter, it can be fabricated more precisely than a longer via that ends at the bottom magnetic layer 1710 at the base of step 1708. Accordingly, the width of the via 1702 can be more precisely controlled in certain manufacturing processes. In some embodiments, the width of the via 1702 is similar to the height of either the upper magnetic layer 1711 and/or bottom magnetic layer 1710. In some embodiments, the width of the via 1702 is less than twice a thickness of, or less than 5 times a thickness of, either the upper magnetic layer 1711 and/or bottom magnetic layer 1710. In some embodiments, via 1702 can include a contact base where the via 1702 interfaces with the bottom magnetic layer 1710, the contact base having a structure described, for example, with respect to FIG. 24F. In some embodiments, the via 1702 is substantially uniform throughout its entire height and substantially contacts the bottom magnetic layer 1710.

Figure 27:
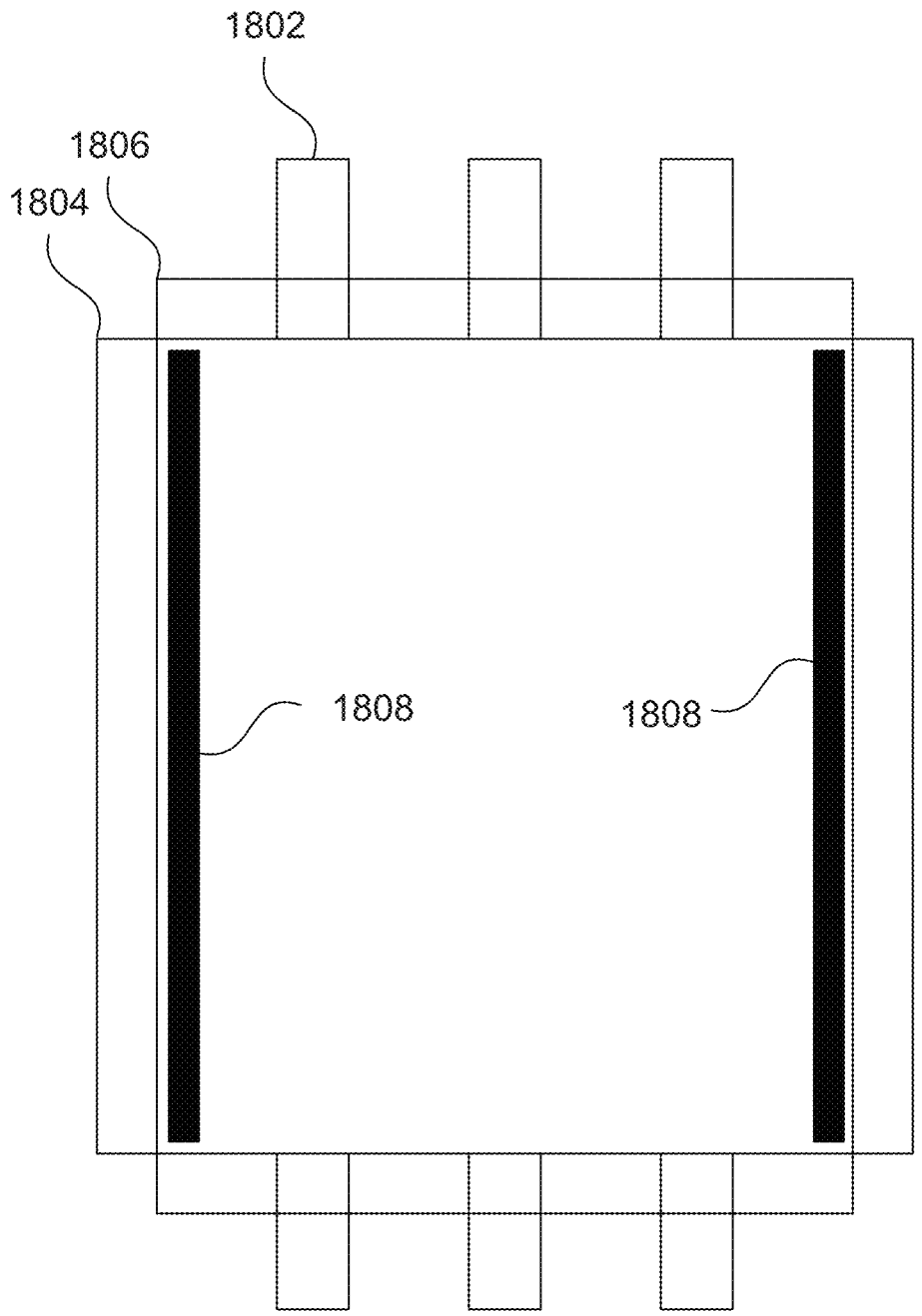
FIG. 27 shows an example plan view that includes masks for making vias in accordance with an embodiment.

FIG. 27 shows an example plan view of masking during processing for making vias. FIG. 27 includes a plurality of conductors 1802 of coils, a first mask 1804, a second mask 1806, and magnetic vias 1808. In some embodiments, there can be a vertical topology height difference (the height going into/coming out of the page in FIG. 27) between the conductors 1802 and the vias 1808. The vias 1808 extend to a lower topology, and the conductors 1802 are at a higher topology. It can be desirable to define both the vias 1808 and the conductors 1802 of coils at a good resolution with sharp edges and/or other features.

The first mask 1804 can be used to define a length of a magnetic core in the vertical direction of the page. The first mask 1804 can leave areas for vias relatively wide. The first mask 1804 can be used with a thick resist (e.g., a spray coat) and used with large-scale geometry stepper.

The second mask 1806 can be used in conjunction with more focused lithography that provides well-defined features at lower topologies at the expense of resolution at higher topologies. The second mask 1806 can used with a thinner resist and with a fine geometry stepper. The second mask 1806 can be used to define vias with a relatively fine tolerance such as 2-3 μm for vias while providing coarser resolution for defining features in the conductor area, such as 20-30 μm tolerance. The via area can be minimized and have a width comparable to a height of the upper magnetic layer or bottom magnetic layer of the magnetic core. In some embodiments, the via can be made with a substantially uniform width along the entirety of the via (e.g., without a wider contact base extending perpendicularly outward at the bottom of the via) while still making proper contact with the bottom magnetic layer.

Vias 1808 can be used in addition to or as an alternative to via structures in contact bases, such as described with respect to FIG. 24F.

Any of the transformers discussed herein can be implemented to transfer power across an isolation barrier while also providing galvanic isolation. In some instances an integrated direct current-to-direct current (DC-DC) converter can be implemented on the same chip as the transformer. Any of the transformers discussed herein can transfer power from a circuit in one voltage domain to a circuit in another voltage domain.

According to some embodiments, the width of a via may be less than 500% of a thickness of the upper layer of a magnetic core.

According to some embodiments, the width of a via may be less than 200% of a thickness of the lower layer of a magnetic core.

According to some embodiments, a via of a magnetic core of a transformer makes direct contact with a first layer of the magnetic core.

According to some embodiments, a transformer may comprise a primary coil extending through a magnetic core and a secondary coil extending through the magnetic core, wherein the magnetic core includes a via.

According to some embodiments, a transformer may comprise a primary coil and/or a secondary coil that has a non-uniform turns density configured to compensate for magnetic core saturation non-uniformity of the magnetic core.

The disclosed technology can be implemented in any application or in any device with a need for a magnetic core with reduced core saturation non-uniformity. Aspects of this disclosure can be implemented in various electronic devices. Examples of the electronic devices can include, but are not limited to, consumer electronic products, parts of the electronic products, electronic test equipment, cellular communications infrastructure, etc. Examples of the electronic devices can include, but are not limited to, precision instruments, medical devices, wireless devices, a mobile phone such as a smart phone, a telephone, a television, a computer monitor, a computer, a modem, a hand-held computer, a laptop computer, a tablet computer, a wearable computing device such as a smart watch, a personal digital assistant (PDA), a vehicular electronics system, a microwave, a refrigerator, a vehicular electronics system such as automotive electronics system, a stereo system, a DVD player, a CD player, a digital music player such as an MP3 player, a radio, a camcorder, a camera, a digital camera, a portable memory chip, a washer, a dryer, a washer/dryer, a wrist watch, a clock, etc. Further, the electronic devices can include unfinished products.

While certain embodiments have been described, these embodiments have been presented by way of example only, and are not intended to limit the scope of the disclosure. Indeed, the novel apparatus, methods, and systems described herein may be embodied in a variety of other forms; furthermore, various omissions, substitutions and changes in the form of the methods and systems described herein may be made without departing from the spirit of the disclosure. For example, while the disclosed embodiments are presented in a given arrangement, alternative embodiments may perform similar functionalities with different components and/or circuit topologies, and some elements may be deleted, moved, added, subdivided, combined, and/or modified. Each of these elements may be implemented in a variety of different ways. Any suitable combination of the elements and acts of the various embodiments described above can be combined to provide further embodiments. The accompanying claims and their equivalents are intended to cover such forms or modifications as would fall within the scope and spirit of the disclosure.

Various aspects of the novel systems, apparatuses, and methods are described herein. Aspects of this disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein, one skilled in the art should appreciate that the scope of the disclosure is intended to cover any aspect of the novel systems, apparatuses, and methods disclosed herein, whether implemented independently of or combined with any other aspect. For example, an apparatus may be implemented or a method may be practiced using any number of the aspects set forth herein. In addition, the scope is intended to encompass such an apparatus or method which is practiced using other structure, functionality, or structure and functionality in addition to or other than the various aspects set forth herein. It should be understood that any aspect disclosed herein may be embodied by one or more elements of a claim.

The terms "approximately," "substantially" and "about" may be used to mean within ±20% of a target value in some embodiments, within ±10% of a target value in some embodiments, within ±5% of a target value in some embodiments, and yet within ±2% of a target value in some embodiments. The terms "approximately" and "about" may include the target value.

What is claimed is:

1. A transformer for transferring power and providing galvanic isolation, the transformer comprising:

a primary coil and a secondary coil;

a magnetic core comprising a lower layer of the magnetic core, an upper layer of the magnetic core, and a via coupling the lower layer of the magnetic core to the upper layer of the magnetic core;

a first insulation layer formed over the lower layer of the magnetic core; and a separation layer formed over the lower layer of the magnetic core and arranged alongside the first insulation layer, wherein at least a portion of the primary coil, at least a portion of the secondary coil, the separation layer, and the first insulation layer are disposed between the lower layer and the upper layer of the magnetic core;

wherein the at least a portion of the primary coil contacts the first insulation layer without contacting the separation layer;

wherein the via passes through the separation layer to provide a pathway for magnetic flux between the lower layer and the upper layer of the magnetic core;

wherein the separation layer is arranged between the lower layer and the upper layer of the magnetic core on opposing sides of the via; and wherein the separation layer and the first insulation layer are formed from different materials.

2. The transformer of claim 1, wherein the via has a width that is narrower than a width of a portion of the lower layer of the magnetic core that extends substantially parallel to the upper layer of the magnetic core.

3. The transformer of claim 1, wherein the lower layer of the magnetic core is coupled to a semiconductor substrate, and wherein a distance from the separation layer to the semiconductor substrate is smaller than a distance from either the primary or secondary coil to the semiconductor substrate.

4. The transformer of claim 1, further comprising a lamination layer at an interface coupling the lower layer to the via.

5. The transformer of claim 4, wherein a thickness of the lamination layer is 10 nm or smaller.

6. The transformer of claim 1, wherein the via passes through the separation layer at a sloped angle.

7. The transformer of claim 1, further comprising a plurality of vias arranged in at least two rows.

8. The transformer of claim 1, further comprising additional vias arranged in a row with the via.

9. The transformer of claim 1, wherein at least one of the primary coil or the secondary coil has a non-uniform turns density configured to compensate for magnetic core saturation non-uniformity of the magnetic core.

10. The transformer of claim 1, wherein the first insulating layer contacts the separation layer.

11. The transformer of claim 1, wherein the first insulating layer and the separation layer both contact the lower layer of the magnetic core.

12. The transformer of claim 1, wherein the separation layer is thinner than a combination of thicknesses of the portion of the primary coil, the portion of the secondary coil, and the first insulating layer.

13. A transformer for transferring power and providing galvanic isolation, the transformer comprising:

an upper layer of a magnetic core;

a lower layer of the magnetic core;

a first conductor coil at least part of which is arranged between the upper layer and the lower layer of the magnetic core;

a second conductor coil at least part of which is arranged between the upper layer and the lower layer;

a via comprising magnetic material, the via providing a pathway for magnetic flux between the upper layer and the lower layer;

a separation layer formed from a first material, at least a portion of the separation layer being arranged on and in contact with the lower layer of the magnetic core and between the upper layer and the lower layer of the magnetic core, wherein the via is formed by a pathway through the separation layer; and an insulating layer formed from a second material, different from the first material, at least a portion of the insulating layer being arranged on and in contact with the lower layer of the magnetic core and between the upper layer and the lower layer of the magnetic core, wherein the first conductor coil contacts the insulating layer and does not contact the separation layer.

14. The transformer of claim 13, wherein the via has substantially the same width along the entirety of the via.

15. The transformer of claim 13, wherein at least one of the first conductor coil or the second conductor coil has a non-uniform turns density configured to compensate for magnetic core saturation non-uniformity of the magnetic core.

16. The transformer of claim 13, further comprising a lamination layer at an interface coupling the upper layer to the via.

17. The transformer of claim 13, wherein the insulating layer contacts the separation layer.

18. A transformer for transferring power and providing galvanic isolation, the transformer comprising:

an upper layer of a magnetic core;

a lower layer of the magnetic core;

a coil, at least part of which is arranged between the upper layer and the lower layer of the magnetic core;

a separation layer formed from a first material, at least a portion of the separation layer being arranged on and in contact with the lower layer of the magnetic core and between the upper layer and the lower layer of the magnetic core, wherein a via providing a pathway for magnetic flux between the upper layer and the lower layer of the magnetic core is formed by an opening in the separation layer; and an insulating layer formed from a second material, different from the first material, at least a portion of the insulating layer being arranged on and in contact with the lower layer of the magnetic core and between the upper layer and the lower layer of the magnetic core, wherein the insulating layer is thicker than the separation layer.

19. The transformer of claim 18, wherein the separation layer comprises a first portion that contacts the insulating layer and a second portion that does not contact the insulating layer, and wherein the first and second portion of the separation layer are arranged on opposing sides of the via.

20. The transformer of claim 18, wherein a width of the via is less than a thickness of the upper layer of the magnetic core.

* * * * *